US008628594B1

(12) United States Patent
Braly

(10) Patent No.: US 8,628,594 B1
(45) Date of Patent: Jan. 14, 2014

(54) HIGH OCTANE UNLEADED AVIATION FUEL

(76) Inventor: George W. Braly, Ada, OK (US)

( * ) Notice: Subject to any disclaimer, the term of this patent is extended or adjusted under 35 U.S.C. 154(b) by 251 days.

(21) Appl. No.: 12/958,390

(22) Filed: Dec. 1, 2010

Related U.S. Application Data

(60) Provisional application No. 61/265,606, filed on Dec. 1, 2009, provisional application No. 61/316,158, filed on Mar. 22, 2010, provisional application No. 61/319,255, filed on Mar. 30, 2010.

(51) Int. Cl.
*C10L 1/22* (2006.01)

(52) U.S. Cl.
USPC ..... 44/426

(58) Field of Classification Search
USPC ..... 585/14; 44/426
See application file for complete search history.

(56) References Cited

U.S. PATENT DOCUMENTS

| | | | |
|---|---|---|---|
| 1,495,501 | A | 5/1924 | Taber |
| 1,571,862 | A | 2/1926 | Midgley, Jr. |
| 1,592,953 | A | 7/1926 | Midgley, Jr. |
| 1,605,663 | A | 11/1926 | Kettering et al. |
| 1,606,431 | A | 11/1926 | Hamby |
| 1,713,589 | A | 5/1929 | Bereslavsky |
| 1,741,032 | A | 12/1929 | Minter |
| 1,844,362 | A | 2/1932 | Ihrig |
| 2,394,180 | A | 2/1946 | Imm |
| 2,398,197 | A | 4/1946 | Stanly |
| 2,409,156 | A | 10/1946 | Schulze et al. |
| 2,410,846 | A | 11/1946 | Walters |
| 2,413,262 | A | 12/1946 | Stirton |
| 2,476,315 | A | 7/1949 | Morrison |
| 2,560,602 | A | 7/1951 | Schulze |
| 2,637,635 | A | 5/1953 | McLaughlin |
| 2,917,561 | A | 12/1959 | Eby |
| 3,212,867 | A | 10/1965 | Ockerbloom |
| 4,010,358 | A | 3/1977 | Morris |
| 4,266,947 | A | 5/1981 | Hartle et al. |
| 4,294,587 | A | 10/1981 | Burns |
| 4,331,024 | A | 5/1982 | Childs et al. |
| 4,408,585 | A | 10/1983 | Stuckas |
| 4,452,207 | A | 6/1984 | Moore, Jr. |
| 4,695,292 | A | 9/1987 | Osborg |
| 4,897,087 | A | 1/1990 | Blain et al. |
| 5,087,781 | A | 2/1992 | Schutz et al. |
| 5,125,235 | A | 6/1992 | Yanagihara et al. |
| 5,284,984 | A | 2/1994 | Dessau et al. |
| H1305 | H | 5/1994 | Townsend et al. |
| 5,385,588 | A | 1/1995 | Brennan et al. |
| 5,470,358 | A | 11/1995 | Gaughan |
| 5,653,866 | A | 8/1997 | Jessup et al. |
| 5,851,241 | A | 12/1998 | Studzinski et al. |
| 5,891,202 | A | 4/1999 | Barratt et al. |
| 5,925,152 | A | 7/1999 | Barratt et al. |
| 5,941,222 | A | 8/1999 | Braly |
| 5,948,126 | A | 9/1999 | Barratt et al. |
| 5,962,775 | A | 10/1999 | Liiva et al. |
| 5,978,728 | A | 11/1999 | Fontana et al. |
| 6,187,064 | B1 | 2/2001 | Henderson |
| 6,238,446 | B1 | 5/2001 | Henderson |
| 6,258,134 | B1 | 7/2001 | Studzinski |
| 6,297,417 | B1 | 10/2001 | Samson et al. |
| 6,411,886 | B1 | 6/2002 | Morra et al. |
| 6,451,075 | B1 | 9/2002 | Schoppe et al. |
| 6,565,617 | B2 | 5/2003 | Kalghatgi |
| 6,767,372 | B2 | 7/2004 | Barnes et al. |
| 6,858,048 | B1 | 2/2005 | Jimeson et al. |
| 7,039,518 | B2 | 5/2006 | Ingram et al. |
| 7,416,568 | B2 | 8/2008 | Clark |
| 7,462,207 | B2 | 12/2008 | Clark |
| 7,553,404 | B2 | 6/2009 | Clark et al. |
| 7,740,668 | B2 | 6/2010 | Gaughan |
| 7,833,295 | B2 | 11/2010 | Clark |
| 7,862,629 | B2 | 1/2011 | Gaughan et al. |
| 7,897,034 | B2 | 3/2011 | De Oliveira et al. |
| 8,049,048 | B2 | 11/2011 | Rusek et al. |

(Continued)

FOREIGN PATENT DOCUMENTS

| | | |
|---|---|---|
| AU | 2006351908 B2 | 3/2011 |
| CA | 2672211 | 6/2008 |

(Continued)

OTHER PUBLICATIONS

Davidson, Hanson, Interpreting Shock Tube Ignition Data, Paper 03F-61, Mechanical Engineering Department, WSSCI Fall 2003 Meeting, Oct. 20-21, 2003, University of California (24 pages).
Cummings, H.K., Detonation Rating of Aviation Fuels, 1st World Petroleum Congress, Jul. 18-24, 1933, London, UK, (13 pages).
Avgas Review—AFC 2007, Alisdair Clark; Clark Aviation Fuels Committee, AFC 21st Mar. 2007 (27 pages).
Executive Summary, CRC Research Results, Unleaded High Octane Aviation Gasoline, A Report to the CRC Unleaded AVGTAS Development Panel, Apr. 24, 2008 (9 pages).
Atwood, David, Full-Scale Engine Detonation, Tests of 47 Unleaded, High-Octane Blends, Sep. 2008, Final Report, DOT/FAA/AR-08/40 (287 pages).
Atwood, David, Full-Scale Engine Knock Tests of 30 Unleaded, High-Octane Blends, Sep. 2004, Final Report, DOT/FAA/AR-04-25 (314 pages).

(Continued)

*Primary Examiner* — Cephia D Toomer
(74) *Attorney, Agent, or Firm* — R. Reams Goodloe, Jr.

(57) ABSTRACT

An unleaded aviation fuel blend. The fuel blend is provided by blending an unleaded aviation gasoline base fuel which may include iso-octane and iso-pentane, and an effective amount of a selected alkyl benzene to improve the functional engine performance to avoid harmful detonation sufficient to meet or exceed selected standards for detonation performance requirements in full scale aircraft piston spark ignition engines designed for use with Grade 100LL avgas. Advantageous alkylated benzenes include those having a meta-ring position between alkyl groups. Alkyl groups may be provided at least in part by methyl groups. In an embodiment, the alkyl benzene may include 1,3-dimethylbenzene. In an embodiment, two or more alkylated benzenes may be provided. In an embodiment, 1,3,5-trimethylbenzene may be provided. Suitable alkylated benzenes may include a mixture of xylene isomers. Selected aromatic amines, such as m-toluidine, may also be added to increase motor octane number.

85 Claims, No Drawings

(56) References Cited

U.S. PATENT DOCUMENTS

| | | | | |
|---|---|---|---|---|
| 8,232,437 | B2 | 7/2012 | Clark et al. | |
| 2002/0005008 | A1 | 1/2002 | Studzinski et al. | |
| 2002/0045785 | A1 | 4/2002 | Bazzani et al. | |
| 2002/0055663 | A1 | 5/2002 | Barnes et al. | |
| 2003/0000131 | A1 | 1/2003 | Henry et al. | |
| 2003/0040650 | A1 | 2/2003 | Butler et al. | |
| 2003/0183554 | A1 | 10/2003 | Bazzani et al. | |
| 2004/0124122 | A1 | 7/2004 | Clark | |
| 2005/0044778 | A1 | 3/2005 | Orr | |
| 2005/0144834 | A1 | 7/2005 | Jimeson et al. | |
| 2005/0229480 | A1 | 10/2005 | Gaughan et al. | |
| 2006/0052650 | A1 | 3/2006 | Thebault et al. | |
| 2006/0086040 | A1 | 4/2006 | De Oliveira et al. | |
| 2006/0123696 | A1 | 6/2006 | Gaughan et al. | |
| 2006/0225340 | A1 | 10/2006 | Gaughan et al. | |
| 2006/0288635 | A1 | 12/2006 | Seyfried | |
| 2007/0033859 | A1 | 2/2007 | Ketley et al. | |
| 2007/0215519 | A1 | 9/2007 | Dierickx | |
| 2008/0134571 | A1* | 6/2008 | Landschof et al. | 44/424 |
| 2008/0168706 | A1 | 7/2008 | Rusek et al. | |
| 2008/0172931 | A1 | 7/2008 | Bazzani et al. | |
| 2008/0178519 | A1 | 7/2008 | Bazzani et al. | |
| 2008/0244961 | A1 | 10/2008 | Rusek et al. | |
| 2008/0244963 | A1 | 10/2008 | Demoment et al. | |
| 2008/0289250 | A1 | 11/2008 | Bazzani et al. | |
| 2008/0295388 | A1 | 12/2008 | Bazzani et al. | |
| 2009/0013589 | A1 | 1/2009 | Aradi et al. | |
| 2009/0229172 | A1 | 9/2009 | Brady et al. | |
| 2009/0229173 | A1 | 9/2009 | Gosling | |
| 2010/0018112 | A1 | 1/2010 | Russo et al. | |
| 2010/0263262 | A1* | 10/2010 | Gaughan | 44/347 |
| 2012/0029251 | A1 | 2/2012 | Hemighaus et al. | |
| 2012/0080000 | A1 | 4/2012 | Landschof et al. | |
| 2012/0279113 | A1 | 11/2012 | Landschof et al. | |

FOREIGN PATENT DOCUMENTS

| | | | |
|---|---|---|---|
| EP | 1650289 | A1 | 4/2006 |
| EP | 1611224 | B1 | 5/2010 |
| EP | 2537913 | A1 | 12/2012 |
| WO | WO 97/44413 | | 11/1997 |
| WO | WO 98/22556 | | 5/1998 |
| WO | WO 99/49003 | | 9/1999 |
| WO | WO 02/22766 | A1 | 3/2002 |
| WO | WO 2005/100513 | A2 | 10/2005 |
| WO | WO 2006/026657 | A3 | 3/2006 |
| WO | WO 2006/060364 | A3 | 8/2006 |
| WO | WO 2007/074226 | A1 | 7/2007 |
| WO | WO 2008/013922 | A1 | 1/2008 |
| WO | WO 2008/073118 | A1 | 6/2008 |
| WO | WO 2009/152495 | A2 | 12/2009 |
| WO | WO 2009/152495 | A3 | 12/2009 |
| WO | WO 2010/004395 | A1 | 1/2010 |
| WO | WO 2011/035219 | A2 | 3/2011 |
| WO | WO 2011/035219 | A3 | 3/2011 |
| WO | WO2011/109575 | A2 | 9/2011 |
| WO | WO2011/109575 | A3 | 9/2011 |

OTHER PUBLICATIONS

Pye, Barton, Knock-Rating: Motor Gasoline and Aviation Gasoline, 1st World Petroleum Congress, Jul. 18-24, 1933, London, (6 pages).

Evans, Garner, The Knock-Ratings of Gasolines and Their Chemical Composition, 2nd World Petroleum Congress, Jun. 14-19, 1937, Paris, France, (7 pages).

Heron, Gillig, Supercharged Knock Testing, 2nd World Petroleum Congress, Jun. 14-19, 1937, Paris, France, (11 pages).

Hofman, Lapeyrouse, Sweeney, New Blending Agents for Aviation Gasoline of 100 Octane Number, 2nd World Petroleum Congress, Jun. 14-19, 1937, Paris, France, (8 pages).

Grebenshchikov, Influence of Gasoline Distillation Curve on Carburetor Icing, Journal Article, UDC 665.733.033.542.488, All-Union Scientific-Research Institute for Petroleum Processing (1981) (4 pages).

Persson, Hjelmco Oil AB, Presentation—Future fuels of aviation IAOPA WA, Toronto, 2006, Sweden (33 pages).

Hjelmberg, Hjelmco Oil AB, Presentation—Future fuels of aviation, Vasteras, Jan. 23, 2007 (33 pages).

Hjelmberg, Hjelmco Oil AB, Presentation—23 years of experience with Unleaded AVGAS in Sweden, (2004) (34 pages).

Hjelmco Oil, The Unleaded Aviation Gasoline With Improved Environmental Qualities, (AVGAS 91/96 UL), Edition: V. (Oct. 17, 1997) (22 pages).

Atwood, David, Full-Scale Engine Detonation and Power Performance Evaluation of Swift Enterprises 702 Fuel, Jan. 2009 Final Report, DOT/FAA/AR-08/53 (181 pages).

Research Results Unleaded High Octane Aviation Gasoline, Final Report, CRC Project No. AV-7-07, Jun. 2010 (298 pages).

Chevron, Aviation Fuels Technical Review, 2006 (96 pages).

Sakrison, Article, EAA Air Venture, Standards Sough for Unleaded Aviation Fuel, Aug. 1, 2008 (7 pages).

Department of the Navy, Advance Notice of Proposed Rulemaking on Lead Emissions from Piston-Engine Aircraft Using Leaded Aviation Gasoline, 75 FR 22440, Oct. 24, 2010, (3 pages).

Bailey, Bunker, USSAF Europe WWII 100/150 Gradefuel, Sep. 1944 (10 pages).

Barnett, Report 1026, NACA Investigation of Fuel Performance in Piston-Type Engines (1951) (194 pages).

Sparrow, Report No. 232, Fuels for High-Compression Engines, NACA Report (1926) (20 pages).

Evaluation of Reciprocating Aircraft Engines with Unleaded Fuels, Dec. 1999, Final Report, DOT/FAA/AR-99/70 (82 pages).

Charnes, Cooper, Mellon, Econometrica, Journal of the Econometric Society, Blending Aviation Gasolines, A Study in Programming Interdependent Activities in an Integrated Oil Company, Accessed: 17:18 (Apr. 1952) (26 pages).

Johnston, Farrell, Laminar burning velocities and Markstein lengths of aromatics at elevated temperature and pressure, Proceedings of the Combustion Institute, 30 (2005) 217-224 (8 pages).

Executive Summary, CRC Research Results, Toward Development of an Unleaded High Octane Aviation Gasoline, A Report to the CRC Unleaded AVGAS Development Group, Apr. 1, 2003 (6 pages).

CRC Unleaded AVGAS Development Group Meeting, May 1, 2006, Alexandria, Virginia (8 pages).

Speight, The Chemistry and Technology of Petroleum, 4th Edition, CRC Press, Copyright, 2007 (p. 745) (1 page).

Atwood, David, Full-Scale Engine Endurance Test of Swift Enterprises UL 102 Fuel, Jul. 2010, Final Report, DOT/FAA/AR-10/13 (70 pages).

Swift Enterprises, Presentation, Swift Sustainable Aviation Fuels, A High Octane Alternative to 100LL, EAA Airventure, Jul. 30, 2009 (28 pages).

Simpson, Martin J., The Douglas A/B-26 Invader, Fuel, (date unknown) (16 pages).

Millner, Paul, AVGAS 2020: The Future Fuel, Jun. 2006 (7 pages).

Atwood, David, High-Octane and Mid-Octane Detonation Performance of Leaded and Unleaded Fuels in Naturally Aspirated, Piston, Spark Ignition Aircraft Engines, Mar. 2007, Report, DOT/FAA/AR-TN07/5 (48 pages).

Desrosier, Presentation, Beyond 100LL, Next Steps in Addressing Leaded Aviation Gasoline, General Aviation Manufacturers Association (GAMA), GA AVGAS Coalition—2011 ACI NA Environmental Affairs Conference, Jun. 27, 2011 (28 pages).

Ziulkowski, Collective Knowledge on Aviation Gasolines, Purdeu e-Pubs, Jul. 10, 2011 (213 pages).

(56) References Cited

OTHER PUBLICATIONS

Rumizen, Aviation Gasoline, Status and Future Prospects, Presentation, 34th Annual FAA Forecast Conference, Apr. 1, 2009 (9 pages).
Orr, Fuel-ish Questions, Fuel-ish Answers, FAA Aviation News, Jul./Aug. 2009 (4 pages).
Waxman, Letter to Michael P. Huerta, FAA, Oct. 23, 2012 (2 pages).
Midgley, Shell, Presentation, AVGAS Octane, Is Motor Octane Number the Whole Story? AFC, Mar. 2010 (18 pages).
Winkle, Aviation Gasoline Manufacture, (1944), Production of Finished Aviation Gasolines, Chapter II cover pages (3 pages) and (pp. 182-183; 191-200).
Ells, AVGAS Alternatives, Feb. 2011, Flyingmag.com (3 pages).
FAA Aviation Safety, Special Airworthiness Information Bulletin, SAIB: NE-11-55, Sep. 14, 2011, Subject: Grade 100VLL Aviation Gasoline, (2 pages).

* cited by examiner

HIGH OCTANE UNLEADED AVIATION FUEL

CROSS REFERENCE TO RELATED APPLICATIONS

This application claims priority under 35 U.S.C. §119(e) of prior U.S. Provisional Application Ser. No. 61/265,606 filed on Dec. 1, 2009, and of prior U.S. Provisional Application Ser. No. 61/316,158 filed on Mar. 22, 2010, and U.S. Provisional Application Ser. No. 61/319,255 filed on Mar. 30, 2010, the disclosures of each of which are incorporated herein in their entirety by this reference.

TECHNICAL FIELD

The present invention relates to fuels for spark ignition piston engines in general aviation aircraft, and more particularly, to fuel blends formulated without lead additives, in order to avoid lead emissions from such engines.

BACKGROUND

The existing fleet of general aviation spark ignition piston engines, as well as new engines currently being delivered, and engines which are overhauled for use as replacements on existing aircraft, typically operate using leaded fuels, as allowed in the United States under an exemption provided by the 1990 Federal Clean Air Act Amendments. As that Act banned the use of leaded fuels for over-the-road vehicles in the Unites States, general aviation aircraft engines have become an increasingly visible source of atmospheric lead emissions. Environmental regulations and threatened regulations throughout the world have thus spurred investigations into the development and evaluation of possible alternative aviation fuels.

Most of the general aviation spark ignition piston engines in use today have been certified in the United States by the Federal Aviation Administration (FAA) for use with leaded aviation gasoline blends that meet the American National Standard No. ASTM D910-07a entitled *Standard Specification for Aviation Gasolines*. Under that standard, for Grade 100 fuel, 1.12 grams of lead per liter are provided in the fuel blend. In the most commonly used fuel, Grade 100LL, known as a "low lead" fuel, 0.56 grams of lead per liter are provided in the fuel blend. Both of those blends provide a minimum "knock value" lean mixture octane number of 99.6 per the ASTM D-2700 Test Method. Also, both of those blends provide a minimum "knock value" rich mixture octane number of 130, per the ASTM D 909 Test Method.

Given the regulatory environment, both in the U.S. and internationally, that seeks to require the minimization or elimination of the use of lead in general aviation aircraft reciprocating piston engines, the US FAA has been instrumental in conducting tests on various heretofore proposed formulations for low lead or no lead aviation gasolines. Their reports are publicly available through the US National Technical Information Service (NTIS), Springfield, Va. 22161. Such studies include the following reports:

(1) DOT/FAA/AR-04/25, entitled Full-Scale Engine Knock Tests of 30 Unleaded, High-Octane Blends, by David Atwood and Julian Canizales, issued by the Office of Aviation Research, Washington, D.C., in September 2004;

(2) DOT/FAA/AR-TN07/5, entitled High-Octane and Mid-Octane Detonation Performance of Leaded and Unleaded Fuels in Naturally Aspirated, Piston Spark Ignition Aircraft Engines, by David Atwood, issued by the U.S. Department of Transportation, Federal Aviation Administration, in March 2007;

(3) DOT/FAA/AR-08/40, entitled Full-Scale Engine Detonation Tests of 47 Unleaded High Octane Blends, by David Atwood, issued by the Office of Aviation Research, Washington, D.C., in September 2008; and (4) DOT/FAA/AR-08/53, entitled Full-Scale Detonation and Power Performance Evaluation of Swift Enterprises 702 Fuel, by David Atwood, issued by the Office of Aviation Research, Washington, D.C., in January 2009.

The September 2004 FAA report describes how over 200 blends of potential future aviation unleaded fuels were considered. Thirty of those blends, ranging in Motor Octane Number (MON) from 96.2 to 105.6 were sufficiently promising to be blended into batches and knock-tested (as determined by ASTM D-2700 standard) in a Lycoming IO-540-K aircraft engine at the FAA William J. Hughes Technical Center in Atlantic City, N.J. Components of such blends included ranges of some (or of all) of various ingredients, including super alkylate, toluene, ethyl tertiary butyl ether, meta-toluidine, ethanol, and methylcyclopentiadienyl manganese tricarbonyl (MMT), which were blended into a base fuel of either aviation alkylate or motor alkylate. Importantly, the FAA researcher reported that the performance of many of the tested blends deviated from that suggested by either their MON or by their performance number (PN).

The March 2007 FAA report compared detonation performance of mid and high octane leaded and unleaded fuels. The fuels were compared at the onset of light detonation. The fuels were tested in a naturally aspirated Lycoming IO-540-K engine and in a naturally aspirated Lycoming IO-320-B engine. For testing, the motor octane number (MON) of fuels was determined by ASTM International (ASTM) specification D2700. The supercharge rich rating was determined by the ASTM D-909 standard. In general, the testing showed that the Grade 100LL fuel (with values minimally meeting the MON and Supercharge Rating of ASTM D910-07a) significantly outperformed the matrix of tested unleaded fuels of equivalent MON, including even those with much higher ASTM Standard D-909 supercharge rich ratings, particularly as seen when operated on full scale aircraft engines rather than the laboratory test engines used to establish the ASTM Standard D-2700 MON and the D-909 rich rating performance number (PN). The March 2007 report indicates that the supercharge rich ratings do not appear to have the same significance for the matrix of unleaded fuels that were tested as they do for leaded hydrocarbon fuels. Based on the blends tested, the report clearly suggests that development of a better detonation performance unleaded aviation fuel would be desirable.

The September 2008 FAA report was a continuation of the research described in the September 2004 report. Based on the results of the potential future aviation unleaded fuel blends earlier tested, another matrix of 47 unleaded fuel blends was developed and detonation tested in a Lycoming IO-540-K aircraft engine at the FAA William J. Hughes Technical Center in Atlantic City, N.J. Components of such blends included varying ranges of "high octane components" such as aviation alkylate, super alkylate, toluene, ethyl tertiary butyl ether (ETBE), meta-toluidine, tert-butylbenzene. The blends contained iso-pentane for volatility control. Comprehensive blend formulations, by both volume fractions and mass fractions of those fuel blends were reported in Tables 2, 3, 4, and 5 of that report. The blends with a target range of 97.6 to 106.3 MON were tested against a baseline leaded reference fuel that met all specifications of ASTM D910-07a for Grade 100LL fuel with minimum MON and minimum performance number (PN) per ASTM D-909. The blends were also tested against a 100LL aircraft fuel purchased at the local airport. Here, the FAA researcher reported that none of the unleaded blends of equivalent or lower MON performed as well as the Grade 100LL fuel in the detonation tests, particularly as seen when operated on full scale engines rather than the laboratory test engines used to establish the ASTM D-2700 MON and the ASTM D-909 rich rating performance number. It was also demonstrated that increased fuel flow of the unleaded blends was required above the fuel flow required for 100LL in order to achieve equivalent detonation performance. In short, the tested blends provided less detonation protection than leaded formulations of equivalent MON, and appeared to potentially be less efficient. Importantly, the researcher again reported that using only motor octane number (MON) based on ASTM D-2700 (for knock rating, lean mixture) to predict full scale engine performance of unleaded fuels, is inadequate.

The January 2009 report provides results of tests on a high octane, bio-fuel (fermentation based) composition identified as Swift 702 fuel, from Swift Enterprises of Indiana. Swift 702 fuel was separately reported by Swift Enterprises, Inc., assignee of U.S. Patent Application Publication No. 2008/0244961 A1, published on Oct. 9, 2008, as being eighty three percent (83%) by weight of mesitylene (also known as, and hereinafter identified by the chemical name 1,3,5tri-methyl benzene), and seventeen percent (17%) by weight of isopentane. The FAA similarly reported that the Swift 702 fuel consisted of two pure chemical compounds. The Swift 702 fuel was reported by the FAA to have a motor octane number (MON) of 104.4, as determined by ASTM D-2700. The Swift 702 fuel was detonation tested in a Lycoming IO-540-K aircraft engine used in the tests noted in the two reports above. Also, the Swift 702 fuel was tested in a turbocharged non-intercooled Lycoming TIO-540-J2BD aircraft engine. These two engines were reported by the FAA as having been previously determined as having the highest octane requirements of engines in the active general aviation fleet. The Swift 702 fuel provided slightly better detonation performance than Grade 100LL fuel that was purchased from the local airport aviation gasoline fixed base operator. However, it did not meet the 50%, 90%, and end distillation points of the then current ASTM D910-07a specification. And, the energy content was noted as being only ninety three point six percent (93.6%) of Grade 100LL on a mass basis. Such a reduction in energy content, in conjunction with the higher fuel density, will reduce the available payload of the aircraft for a given trip of a given range. In some cases, such a reduction will be unacceptable to the operator, and may require expensive re-certification of the aircraft. Thus, it would be desirable that any replacement aviation fuel more closely meet the presently existing ASTM minimum specifications with respect to energy content per unit mass of fuel, in order to minimize any potential loss of range or payload for an aircraft using such fuels. And, it would be desirable to provide a replacement aviation fuel that minimizes the quantity of 1,3,5tri-methyl benzene that must be produced to provide sufficient unleaded fuel to the aviation marketplace, since such compound is not presently produced in commodity quantities for fuel blending, and may be more expensive, even in large scale production, than other possible unleaded aviation gasoline components.

In other work, U.S. Pat. No. 5,470,358, entitled Unleaded Aviation Gasoline, was issued Nov. 28, 1995 to Gaughan, and assigned to Exxon Research & Engineering Co.; the disclosure of that patent is incorporated herein in its entirety by this reference. The Gaughan patent discloses an unleaded aviation fuel that combines (a) an aviation gasoline base fuel having a motor octane number (MON) of 90-93, with (b) an amount of at least one aromatic amine as that is effective to boost the motor octane number (MON) of the base fuel to at least about 98. However, many high performance aircraft engines require better performing fuels, i.e. fuels that at least have the ability to run at all significant operating conditions in a manner substantially equivalent to that presently provided by at least a fuel that meets the minimum ASTM D910-07a specification for Grade 10011, if not more. An unleaded fuel blend that only provides performance equivalent to that of a 98 MON avgas on a full scale engine will likely fail at times to meet necessary engine performance requirements. Thus, it would be desirable that a fuel provide performance that meets or exceeds the minimum ASTM D910-07a specifications for Grade 100LL fuel. It would be even more desirable to provide a fuel that meets or exceeds in full scale aircraft engine testing the performance of an FBO Grade 100LL fuel having a selected MON. As discussed elsewhere herein, it is common for FBO Grade 100LL fuels to have a selected MON well in excess of the minimum ASTM D910-07a specifications for Grade 100LL fuel.

U.S. Pat. No. 6,258,134 B1, entitled High Octane Unleaded Aviation Gasolines, issued Jul. 10, 2001 to Studzinski et al., and assigned to Texaco, Inc., discloses an unleaded aviation fuel of at least 94 motor octane number (MON). The disclosure of U.S. Pat. No. 6,258,134 B1 is incorporated herein in its entirety by this reference. In an embodiment, that disclosure provides an unleaded aviation fuel having a motor octane number (MON) of at least 94, made up of the combination of (1) an unleaded alkylate base fuel having a boiling point range that is substantially wider than the range of boiling points in aviation base fuel, and having a motor octane number (MON) of at least 91, (2) an alkyl tertiary butyl ether, and (3) an aromatic amine. Yet, high performance aircraft engines require better performing fuels. Further, it would be desirable to provide an unleaded aviation fuel that avoids the use of oxygenated components, such as alcohols or ethers, especially since use of the latter class of compounds has been eliminated by governmental regulation in many countries.

In Europe, Hjelmco Oil AB of Sweden has been selling unleaded avgas of various blends, including a 91/96 motor octane number (MON) unleaded blend that may be used in 91/96 and in 80/97 octane engines. See http://www.hjelmco.com. The 91/96 UL MON blend was first produced in Finland and introduced in 1991, and is now produced in Sweden. Hjelmco now reports on the above noted website that it is considering a Bio-alkylate derived avgas in a possible replacement for existing Grade 100LL avgas. However, in so far as I am aware, they do not yet offer a product that is capable of providing adequate detonation performance in 100/130 octane aviation engines, in spite of their many years of experience in blending and providing unleaded aviation fuels.

Finally, U.S. Pat. No. 6,767,372 B2, entitled Aviation Gasoline Containing Reduced Amounts of Tetraethyl Lead, issued Jul. 27, 2004 to Barnes et al, and assigned to Chevron U.S.A. Inc., discloses an unleaded aviation fuel of at least 94 motor octane number (MON). The disclosure of U.S. Pat. No. 6,767,372 B2 is incorporated herein in its entirety by this reference. In an embodiment, that disclosure provides an unleaded aviation fuel having, measured by volume, (a) about twenty percent (20%) to about eighty percent (80%) of isooctane, (b) about five percent (5%) to about eighteen percent (18%) of toluene, (c) about one percent (1%) to about twenty percent (20%) of $C_4$ to $C_5$ paraffins, (d) greater than zero (0) to about one (1) ml of tetraethyl lead per gallon of the aviation gasoline composition, and (e) the balance of the composition being light alkylate produced in an alkylation unit using hydrogen fluoride or $H_2SO_4$ as a catalyst. In an embodiment, that aviation gasoline is described as being substantially free of ether compounds, such as methyl tertiary butyl ether (MTBE) or ethyl tertiary butyl ether (ETBE) or the like. However, the Barnes et al patent does not describe whether or not there is any possibility within the otherwise described ingredients to completely eliminate the use of tetraethyl lead. And, although it teaches reduced lead compositions in an aviation fuel, it does not provide specific suggestions as to possible formulations using the components described therein that might tend to further minimize or eliminate the use of tetraethyl lead in order to meet or exceed performance standards for presently existing for Grade 100LL aviation fuel.

Thus, in spite of the extensive testing and evaluation by the FAA and by others of various candidate unleaded aviation fuel blends, and other work as noted in the above described patent literature, there still remains an as yet unmet need for an unleaded aviation fuel blend that can be readily used in the existing general aviation piston engine aircraft fleet as a "drop in substitute". Such a fuel, particularly a fuel that is essentially transparent in functionality to the aircraft engine during various flight operations as compared with existing Grade 100LL fuels, and which could be mixed in the aircraft fuel tank in a random manner with existing Grade 100LL fuel formulations, would assist in the reduction or phase out of existing lead containing aviation gasolines. That is because rather than requiring a simultaneous wholesale and widespread switch in aviation fuel availability, existing fuel systems could accommodate and provide a new unleaded aviation fuel as it becomes locally available from suppliers. And, aircraft crews would not need to be concerned with whether previously existing 100LL fuel or a new unleaded aviation fuel blend were available at any particular airfield. Further, it would be advantageous if a new aviation fuel were available that could be utilized with little or no mechanical alterations or replacements of existing aircraft engines or aircraft system adjustments, and which could be used with little or no additional certification or other regulatory changes from the aircraft owner or operator standpoint. And, such a fuel would be of benefit to aircraft engine manufacturers and to aircraft manufacturing companies, as a fuel having such characteristics should enable them to avoid the need for extensive redesigns of equipment, testing, and recertification that might be required if an unleaded aviation fuel with less desirable performance characteristics were selected for widespread use. It would also be especially advantageous if in an embodiment, such a new unleaded aviation fuel, rather than having substantially less than existing energy content for use by the aircraft, would provide as much or more energy per unit volume of fuel tank capacity, i.e. British Thermal Units (BTU's) per gallon, as existing Grade 100LL fuels. In such a manner, it would be particularly advantageous if a new unleaded aviation fuel could be used to take full advantage of the existing mechanical design components with respect to mass flow of air into the engine, and materials of construction utilized in the fuel system, and be capable of operating without knock or detonation at rich and lean air fuel ratio conditions, with existing compression ratios, with full rated power output, in a stable and highly efficient manner in all flight operating conditions, including high power cruise conditions with lean air-fuel mixtures.

Moreover, it would be advantageous to provide a new aircraft fuel that may be produced and distributed as a substitute for, and in the same manner as, existing petroleum feedstock aircraft fuels, using existing refinery production systems and fuel distribution systems. It would be even more useful if such a replacement aircraft fuel were provided that meets the ASTM D910-07a specification for detonation margins and further, either meets the remaining ASTM D910-07a Table 1 requirements or which only exhibits deviations from those requirements of a nature and to an extent that are not operationally significant to the pilot and the aircraft while completely eliminating the use of lead additives.

It would also be advantageous to accomplish such goals while providing a replacement aircraft fuel suitable for "drop-in" substitution, fully fungible with existing Grade 100LL aviation gasoline, in order to minimize the extent, complexity, and cost of any recertification efforts of the high performance, high-octane fuel powered engines found in existing general aviation aircraft. As used herein, the term "drop-in" substitution is directed to a fuel that meets aircraft engine performance requirements from an operational standpoint, and can be used transparently, from the operational standpoint (including fueling of and holding in the fuel tank, holding and processing in the fuel systems of an aircraft during storage and during operation, and consumed by combustion during operation of the aircraft engine, and producing environmentally acceptable products of combustion). As such, a "drop-in" fuel as described herein may or may not meet all of the current ASTM D910-07a specifications requirements (or a future/then current later generation similar fuel specification), except for the absence of lead. Unofficially, in some aviation fuels industry circles, such usage—i.e. meeting performance requirements but not strictly meeting ASTM or other specifications—might otherwise be known as having the capability of a "quasi-drop-in" fuel—i.e. a fuel that meets performance requirements but not strictly all of the applicable ASTM D910-07a specifications. In any event, it would be very helpful to the general aviation piston engine user community to have available a fuel which could be placed in the aircraft tanks and used without regard to changes in mechanical components or aircraft performance, and which will therefore minimize or eliminate regulatory paperwork. It would be even more helpful, and quite advantageous, for a new unleaded aviation fuel to be made available that meets such objectives, and that also can be used without change in existing operational manuals or procedures.

SUMMARY

Exemplary unleaded aviation fuel blends are described herein, and methods for preparation of the same. In an embodiment, such new unleaded aviation fuel blend provides a drop-in substitution that should enable use of full rated power output from existing engines, in a manner equivalent to the power output obtained when using existing FBO Grade 100LL avgas blends. Further, in an embodiment, such a new unleaded aviation fuel blend should enable aircraft engine operation in a fuel efficient and economical manner, especially as compared to potential losses that might arise in other heretofore proposed Grade 100LL aviation fuel substitutes.

In an embodiment, a novel unleaded fuel blend is provided for use in piston engines. In an embodiment, an unleaded fuel blend includes (a) at least one unleaded aviation gasoline base fuel having a selected motor octane number (MON), and (b) an amount of a selected alkyl benzenes effective to increase the detonation performance of the unleaded fuel blend to the equivalent, or better than, the detonation performance in a full scale aircraft engine of Grade 100LL avgas which minimally meets the motor octane rating requirements set forth in ASTM Standard D910-07a. In an embodiment, selected alkyl benzenes may include one or more di-alkyl or tri-alkyl benzene compounds. In an embodiment, such compounds having methyl groups in the meta-ring position. In an embodiment, selected alkyl benzenes may include dimethylbenzenes. In an embodiment, such alkyl benzenes may include trimethylbenzenes. In an embodiment, selected dimethylbenzenes may include 1,3-dimethylbenzene (also known as meta-xylene or m-xylene). In an embodiment, the amount of 1,3-dimethylbenzene may be at least about forty percent (40%) by weight of an unleaded fuel blend. Another embodiment for a useful unleaded fuel blend includes (a) about fifty five percent (55%) to about forty five percent (45%) by weight of an unleaded aviation gasoline base fuel, and (b) about forty five percent (45%) by weight to about fifty five percent (55%) by weight of 1,3-dimethylbenzene. In an embodiment, the amount of 1,3-dimethylbenzene may be about forty five percent (45%) by weight, or more, of an unleaded fuel blend. In an embodiment, the amount of 1,3-dimethylbenzene may be about fifty percent (50%) by weight, or more, of an unleaded fuel blend. In yet other embodiments, the amount of 1,3-dimethylbenzene may be about fifty five percent (55%) by weight, or more, of an unleaded fuel blend.

In an embodiment, a suitable alkyl benzene may be trimethylbenzene. In an embodiment, a useful trimethylbenzene may be 1,3,5-trimethylbenzene (also known as mesitylene). In an embodiment, the amount of 1,3,5-trimethylbenzene may be at least about twenty percent (20%) by weight of an unleaded fuel blend. In an embodiment the amount of 1,3,5-trimethylbenzene may be thirty percent (30%), or more, by weight of an unleaded fuel blend. In an embodiment, the amount of 1,3,5-trimethylbenzene may be up to about fifty percent (50%) by weight of an unleaded fuel blend.

In an embodiment, the selected alkyl benzene(s) such as just described in the preceding paragraph are provided in an amount effective to increase the detonation performance of the unleaded aviation fuel blend to the equivalent, or better than, the detonation performance in a full scale aircraft engine of a selected FBO Grade 100LL avgas having a selected MON (Full Scale Engine Equivalent MON, or "FSEEMON" as further discussed herein below).

Throughout this disclosure, reference may be made to the "Full Scale Engine Equivalent Motor Octane Number" —which may be abbreviated herein by use of the acronym "FSEEMON". After extensive testing of various candidate aviation fuels in a full scale aircraft engine, for example as noted with respect to various tests described herein below, I have repeatedly observed that certain candidate unleaded aircraft fuel blends, and particularly those blends which include one or more alklylated benzenes that include methyl groups in meta-ring positions, perform much better in a full scale aircraft engine than might be anticipated given the motor octane number ("MON") that such fuels are determined to have, by laboratory testing, when evaluated using standard ASTM testing procedures. Thus, I have developed the term "FSEEMON" —Full Scale Engine Equivalent Motor Octane Number—to describe the comparative detonation performance of a selected aircraft fuel when the selected novel unleaded aviation fuel blend is tested in a full scale aircraft engine, as against performance demonstrated under the same conditions (preferably in the same or identical engines) by a selected FBO Grade 100LL fuel of selected MON as determined by laboratory testing using standard ASTM test procedures. Thus, the FSEEMON of a selected novel unleaded aviation fuel blend may or may not be equivalent to the MON as determined by laboratory testing using standard ASTM test procedures. Generally, in testing the novel unleaded aircraft fuel blends described herein, containing as a significant component one or more alkylated benzenes that include methyl groups in meta-ring positions, I have found that the FSEEMON is greater than would be expected based on the MON of such novel unleaded fuel blend as determined in laboratory testing using standard ASTM test procedures. Not infrequently, the FSEEMON of such an unleaded aircraft fuel is greater than the standard ASTM test MON by one (1) or more points of octane.

Additionally, in order to increase motor octane number (MON) of a final unleaded aviation fuel blend in a cost effective manner, and to simplify the manufacturing of novel unleaded aviation fuel blends as described herein, in various embodiments, an aromatic amine may be utilized by an avgas manufacturer in a method of manufacturing avgas to increase the MON, in order to provide detonation performance in a full scale engine equivalent to that, or better, of an FBO Grade 100LL avgas of a selected MON. In an embodiment, the amount of aromatic amine provided may be somewhere in the range from more than zero up to about six percent (6%) by weight in the final aviation unleaded fuel blend. In an embodiment, a suitable aromatic amine may be m-toluidine.

Various embodiments of an unleaded aviation fuel blend may be formulated using at least one base fuel, and in various cases, one or more selected unleaded aviation gasoline base fuels having a selected motor octane number (MON) of at least 90, or in the range of 90 to 93, or up to about 94, or of about 95, or about 96, or more.

In an embodiment, a suitable unleaded aviation gasoline base fuel may include, by weight, (a) about twenty percent (20%) to about ninety percent (90%) of iso-octane, and (b) about-one percent (1%) to about twenty percent (20%) of $C_4$ to $C_5$ paraffins. In an embodiment, suitable $C_5$ paraffins may include iso-pentane. An effective amount of iso-pentane may be included in the aviation fuel blend as appropriate to achieve a desired distillation curve objective. In an embodiment, such base fuel may additionally include light alkylates. As used herein, the term "light alkylates" includes mixtures of $C_6$ to $C_9$ iso-paraffins. Such compounds may include trimethylpentane isomers, and other iso-paraffins. Generally, light alkylates may be distinguished from iso-octane by their lower octane number(s). In an embodiment, from about zero (0) to about twenty percent (20%) by weight of one or more aliphatic aromatic hydrocarbons may be included in the unleaded aviation gasoline base fuel.

In an embodiment, a suitable aviation base fuel may be provided by a mixture of (a) iso-octane (at about seventy percent (70%) or more by weight) and (b) iso-pentane (at about twenty percent (20%) or less by weight). In an embodiment, a suitable commercial grade iso-octane may be provided having a MON of at least 98, per the ASTM D910-07a test procedure. In an embodiment, a suitable commercial grade iso-octane may be provided having a MON of at least 99, per the ASTM D910-07a test procedure. In an embodiment, a suitable iso-octane may be provided using commercial grade 2,2,4tri-methyl pentane.

Various unleaded aviation base fuels are described explicitly herein below, or are incorporated herein by reference, and one or more of such base fuels may be used in preparation of a useful unleaded aviation fuel blend according to the teachings herein.

In an embodiment, the aviation base fuel may include, or have added thereto, and effective amount of butane to provide desirable distillation curve objectives, and engine starting properties.

In various embodiments, the unleaded fuel blend may include from about ten percent (10%) to about fifteen percent (15%), by weight, of an additional octane increasing aliphatic aromatic hydrocarbon compound. Suitable additional aliphatic aromatic hydrocarbon compounds may include toluene, ortho-xylene, para-xylene, 1,3,5-trimethylbenzene, or other compounds in that class of hydrocarbons. In an embodiment, including those aliphatic aromatic hydrocarbons with octane enhancing properties may be particularly useful, and in particular, those having methyl groups in the meta-ring position. In an embodiment, one or more selected additional aromatic hydrocarbons may be chosen, and amounts or percentages utilized, may be selected, as useful to provide a selected distillation profile for a final aviation fuel blend, as will be understood by those of skill in the art and to whom this specification is directed. In such embodiments, a blend of constituent compounds may be balanced to meet both distillation profile objectives and the performance requirements for a final unleaded aviation fuel blend.

In an embodiment, one or more combinations of the selected additional aromatic hydrocarbons may be chosen, and amounts or percentages utilized, may be selected, as useful to provide a selected distillation profile for a final unleaded aviation fuel blend, as will be understood by those of skill in the art and to whom this specification is directed. For example, 1,2-dimethylbenzene or ethylbenzene may be tolerated in such novel fuel blends, as might be necessary or desirable to utilize cost effective raw materials, such as commercially available xylol blends. And, while 1,4-dimethylbenzene may be likewise tolerated in moderate amounts, the total quantity of same, much as for various other products (and with respect to which those of skill in the art will recognize) should be limited as necessary to assure adequate cold weather and/or freezing point characteristics of the unleaded fuel blend. In such embodiments, it may be advantageous to provide a blend of constituent compounds that is balanced so as to meet both distillation profile objectives (e.g, a distillation distribution curve that meets, or may fairly approximate, the profile set forth under ASTM Standard D86) and the performance properties for a useful final unleaded aviation fuel blend.

DETAILED DESCRIPTION

Exemplary piston engine unleaded aviation fuel blends are set forth herein. Methods for the preparation of such novel unleaded aviation fuel blends, and methods for use of such novel unleaded fuel blend(s) as efficient "drop-in-substitutions" for existing aviation fuels (such as the leaded aviation Grade 100LL fuel) are set forth herein.

As a result of testing of a novel unleaded aviation fuel blend in a full scale aircraft engine test stand, as well as in a turbocharged aircraft in flight, I have now discovered that it is possible to provide, in an embodiment, an unleaded aviation fuel blend by mixing (1) an unleaded aviation gasoline fuel base, with (2) an amount of an alkylated benzene, and particularly methylbenzenes having at least some methyl groups in the meta-ring position (for example, 1,3-dimethybenzene, and 1,3,5-trimethylbenzene) that is effective to increase the detonation performance of the unleaded aviation fuel blend when operated on a full scale aircraft engine to the equivalent, or better than, the full scale engine detonation performance of a Grade 100LL avgas which minimally meets the octane rating requirements set forth in ASTM Standard D910-07a. In other words, in an embodiment, the FSEEMON of the novel aviation fuel blend will be equivalent to the full scale engine performance of a Grade 100LL avgas which meets the minimum MON rating requirements set forth in ASTM D910-07a. Further, such testing has determined that an aviation fuel blend may be formulated that provides detonation performance when operated on full scale aircraft engines to approximately the equivalent of, or better than, the full scale engine detonation performance of a FBO Grade 100LL avgas having a selected MON.

Thus, by testing the novel unleaded fuel blends described herein at load in an actual aircraft engine in a fully instrumented test stand, it was observed that, at least to some extent, the detonation performance on the full scale aircraft engine of certain novel unleaded aviation fuel blends exceeds the detonation performance which would be expected for such blends based on MON test results, or other existing test standards (e.g. the ASTM D 2700 motor octane test required under ASTM Standard D910-07a). Such beneficial synergistic effect seems to especially manifest itself as demonstrated in full scale aircraft engine detonation performance testing in the case of novel unleaded aviation fuel blends which include alkylated benzenes having methyl groups in a meta-ring position. For example, using 1,3-dimethylbenzene in amounts slightly more than about half of the total unleaded fuel blend by weight in connection with other constituents as described herein provides the necessary performance properties. However, various other alkylated benzenes, and such as even 1,4-dimethylbenzene, provide at least some assistance in meeting overall fuel blend performance objectives.

Further, testing has determined that an unleaded aviation fuel blend may be provided by blending (1) an unleaded aviation gasoline fuel base, and (2) an effective amount of 1,3-dimethylbenzene, to provide an unleaded aviation fuel blend that, when operated on full scale aircraft engines provides the detonation performance at least equal to the rich mixture detonation performance of typical FBO Grade 100LL. Such typical Grade 100LL fuels as purchased from the local airport aviation gasoline fixed base operator are referred to herein "FBO Grade 100LL". The detonation performance of FBO Grade 100LL is even better than the detonation performance which would be expected from a Grade 100LL avgas which only minimally meets octane rating requirements set forth in ASTM Standard D910-07a.

Example Blend A:

A turbocharged high compression aircraft test engine was operated to compare (a) an airport available FBO Grade 100LL blend, with (b) a novel unleaded aviation fuel blend having, by weight percent, (a) about fifty four percent (54%) of an unleaded aviation gasoline fuel base of about 95-96 MON and having primary components (by weight) of about seventy nine percent (79%) iso-octane and about fifteen percent (15%) iso-pentane, (b) about forty five percent (45%) of 1,3-dimethylbenzene, and (c) about one percent (1%) by weight of butane. A six (6) cylinder, five hundred fifty (550) cubic inch displacement spark ignition reciprocating aircraft piston engine was operated at rich mixture and lean mixture test conditions. Engine operation on the just described unleaded fuel blend resulted in knock index averages observed in the various cylinders which were demonstrably better than knock index averages during engine operation using a reference test fuel having the characteristics of a leaded aviation gasoline similar to Grade 100LL fuel, but with a measured MON of about 100.5 to 101. Operating results were approximately equivalent to those encountered when operating under lean conditions with 100.5 MON to 101 MON Grade leaded fuels. Test operational results with rich mixtures were nearly as good as those provided by locally purchased FBO Grade 100LL avgas. Thus, it was demonstrated that 1,3-dimethylbenzene may be used, in combination with an unleaded aviation fuel base, as well as a minor amount of other selected ingredients, to provide an unleaded aviation fuel which will enable existing aircraft piston engines to operate free from harmful detonation.

Example Blend B:

A turbocharged high compression aircraft test engine was operated to compare (a) an airport available FBO Grade 100LL blend, with (b) a novel unleaded aviation fuel blend having, by weight percent, (a) about forty five percent (45%) by weight of an aviation unleaded aviation gasoline fuel base of about 95-96 MON, and (b) about fifty five percent (55%) by weight of 1,3-dimethylbenzene. The unleaded aviation gasoline fuel base of about 95-96 MON included as primary components about seventy nine percent (79%) iso-octane and about fifteen percent (15%) iso-pentane, by weight. It will be understood by those of skill in the art that in addition to the aforementioned primary components, refined products such as an unleaded aviation fuel base may typically include an assortment of other hydrocarbons in relatively minor concentrations, as resulting from conventional manufacturing operations.

A six (6) cylinder, five hundred fifty (550) cubic inch displacement spark ignition reciprocating aircraft piston engine was operated in a test stand to compare the novel unleaded fuel blend with the locally purchased FBO Grade 100LL avgas. The knock index averages observed in the various cylinders were very close to those observed when operating using a locally purchased FBO Grade 100LL avgas (which was laboratory tested and determined to have a motor octane number (MON) of approximately 102.5). It is presently believed, based on experience with comparable tests in the aforementioned engine test stand, that the demonstrated performance exhibited by the novel unleaded fuel blend in the full scale test engine is at the level of a FSEEMON of an FBO Grade 100LL having a laboratory test rating of 102 MON.

Example Blend C:

A turbocharged high compression aircraft test engine was operated to compare (a) an airport available FBO Grade 100LL blend with (b) a novel aviation fuel blend having, by weight percent, about sixty seven percent (67%) of an unleaded aviation gasoline fuel base and about thirty three percent (33%) of 1,3,5-tri-methylbenzene. A six (6) cylinder, five hundred fifty (550) cubic inch displacement spark ignition reciprocating aircraft piston engine was operated at about three hundred fifty three (353) brake horsepower at about 0.478 BSFC (brake specific fuel consumption, pounds mass of fuel per hour per horsepower). Some of the operating conditions during testing are set forth below in Table 1. Unexpectedly, the knock index averages observed in the various cylinders were almost identical as between the locally purchased FBO Grade 100LL avgas and the novel unleaded aviation fuel blend, which has been designated in the chart below as G100UL. Each of the six cylinders exhibited very similar Detonation Index Average Numbers, when switched between the two fuels noted above.

The data in Table I is from a popular aircraft engine set up so that it was producing power at levels in excess of its certified power levels. In this instance the engine was set up with a fuel flow best characterized as near a "best power" mixture setting. There was full six cylinder detonation detection instrumentation in use. The engine was observed to occasionally experience light detonation on both fuels on some of the six cylinders. Continued observation of the operation of the engine on each fuel revealed that the level of detonation was consistently measured to be approximately the same intermittent light knock level, regardless of which of the two fuels was being consumed.

In so far as I am aware, it has not been recognized and applied, prior to the present invention, that 1,3,5-tri-methylbenzene may be used to provide a significant portion (e.g. twenty five percent (25%) or more by weight) of a high performance unleaded aviation fuel in combination with an aviation gasoline base fuel composition, to provide a novel fuel blend that meets minimum fuel specification requirements of the current aircraft piston engines in order to operate free from harmful detonation.

Example Blend D:

A turbocharged high compression aircraft test engine was operated to compare (a) a selected airport available FBO Grade 100LL blend having a selected MON, with (b) a novel aviation fuel blend having, by weight percent, about thirty six point six five percent (36.65%) of iso-octane (2,2,4-trimethylpentane), about thirty seven point four percent (37.4%) of 1,3-dimethylbenzene, about four percent (4%) of 1,4-dimethylbenzene, about four point threef percent (4.3%) of 1,2-dimethylbenzene, about two point six percent (2.6%) ethylbenzene, about six point two five percent (6.25%) isopentane, about four percent (4%) n-butane, two point seven percent (2.7%) m-toluidine, and about two point one percent (2.1%) of residual hydrocarbons including various components in minor amounts as might be expected as a result of normal hydrocarbon manufacturing processes. A six (6) cylinder, five hundred fifty (550) cubic inch displacement spark ignition reciprocating aircraft piston engine was operated at about two hundred ninety six (296) brake horsepower using the novel fuel. Some of the operating conditions during testing are set forth below in Table 2. The knock index averages observed in the various cylinders were functionally equivalent as between the locally purchased FBO Grade 100LL avgas having a selected MON and the novel unleaded aviation fuel blend, which has been designated in the chart below as "G100UL Xylene Based Unleaded AVGAS". Each of the six cylinders exhibited very similar Detonation Index Average Numbers, when switched between the two fuels. Thus, the novel unleaded fuel blend set forth above and having performance as noted in Table 2 has a "Full Scale Engine Equivalent MON" equal to the MON of the FBO Grade 100LL avgas against which it was tested. Consistently over many months,

TABLE I

| Grade Fuel | MAP | RPM | Displacement | Fuel Flow (lb/hr) | Comp. Ratio | IAT | Peak Internal Cylinder Pressure | BSFC (lbs/hr/hp) | BHP |
|---|---|---|---|---|---|---|---|---|---|
| FBO 100LL | 33.2 | 2664 | 550 c.i. | 168.6 | 8.5:1 | 156 | ~1080 to 1150 PSI | 0.478 | ~353 |
| G100UL | 33.3 | 2660 | 550 c.i. | 167.9 | 8.5:1 | 159 | ~1060 To 1160 PSI | 0.473 | ~355 |

I have observed the typical FBO Grade 100LL delivered in normal commerce to the facility used for testing to have an ASTM D2700 test motor octane number (MON) of approximately 102.5.

TABLE 2

| Fuel | Manifold Pressure | RPM | Hot CHT | Induction Air Temp | Brake Hp | Fuel Flow GPH | Fuel Flow Corrected For Energy Density | BMEP |
|---|---|---|---|---|---|---|---|---|
| FBO 100LL | 35.3 | 2374 | 444 | 153 | 302 | 20.7 | 20.7 | 183 |
| G100UL Xylene Based Unleaded AVGAS Measured MON 100.5 | 35.3 | 2373 | 441 | 162 | 296 | 20.0 | 20.7 | 179 |

Note that the novel fuel blend set forth in Example D utilized a small amount of m-toluidine for octane enhancement properties. While it may be possible to avoid use of aromatic amines such as m-toluidine when certain compounds having methyl groups at meta-ring locations are included at a relatively high percentage in a final blend (such as 1,3,5-trimethylbenzene), the use of such aromatic amines may be useful in a fuel manufacturing and production environment to "trim" the final fuel blend so as to increase the overall knock performance of the fuel in order to meet a desired full scale engine knock resistance. In this regard, in some embodiments it may be useful to define the knock resistance in terms of "full scale engine equivalent motor octane number" or "FSEEMON". In such a context, and as elsewhere discussed herein, the term "FSEEMON" should be understood to mean the comparative detonation performance seen when a selected fuel is tested in a full scale engine, as against performance demonstrated under the same conditions (preferably in the same or identical engines) by a selected FBO Grade 100LL fuel of selected MON. In an embodiment, it should also be possible to avoid, or minimize, or at least optimize, the amount of aromatic amine that might be necessary to add to such unleaded aviation gasoline base fuel in order to achieve performance equivalent to a desired motor octane number of an FBO Grade 100LL fuel, in a final unleaded fuel blend as taught herein. In any event, a useful range of aromatic amines, such as meta-Toluidine for use in enhancing or trimming the final FSEEMON will be between 1% and 6% by weight. Such addition, if by m-toluidine, will be useful to increase the FSEEMON by between approximately 0.5 and 4 MON points, depending on the particular composition of the fuel blend to which such aromatic amine(s) are added. In any event, in an embodiment, addition of such aromatic amine(s) may be useful for increasing the knock resistance of the fuel blend, and thus increase both the FSEEMON and the MON of such an avgas fuel blend, and if so used, a suitable amine may have the formula

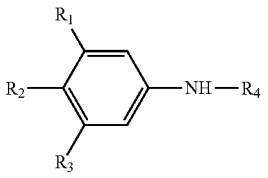

wherein $R_1$, $R_2$, $R_3$ and $R_4$ are hydrogen or a $C_1$-$C_3$ alkyl group. One such aromatic amine would be m-toluidine. In one embodiment, a synergistic blend of 1,3,5-trimethylbenzene and m-toluidine may be utilized in combination with a suitable aviation fuel base to provide a final unleaded aviation fuel blend that meets or exceeds the detonation performance of an FBO Grade 100LL avgas having a selected MON, when the aviation fuel blend is tested in a full scale aircraft engine. In yet another embodiment, a synergistic blend of 1,3-dimethylbenzene and m-toluidine may be utilized in combination with a suitable aviation fuel base to provide a final unleaded aviation fuel blend that meets or exceeds the detonation performance of an FBO Grade 100LL avgas having a selected MON, when the aviation fuel blend is tested in a full scale aircraft engine. Further, mixtures of the dialkylated or trialkylated benzenes may be used in connection with one or more aromatic amines.

Also, in an embodiment, additional aromatic hydrocarbons may be used, supplemental to the aforementioned 1,3-dimethylbenzene, as an octane enhancer for a novel aviation fuel blend. In an embodiment, aliphatic aromatic hydrocarbons of commercial interest and which may be considered environmentally acceptable as octane enhancers include methylbenzene (also known as toluene), and 1,4-dimethylbenzene (also known as para-xylene). In an embodiment, mixtures of 1,2-dimethylbenzene (ortho-xylene) and 1,4-dimethylbenzene (para-xylene) mixtures of roughly equal proportions may be utilized for a octane enhancers. However, increased amounts of 1,4-dimethylbenzene (or especially 1,3-dimethylbenzene) are preferable to increased amounts of 1,2-dimethylbenzene. In an embodiment, commercially available xylol solvent mixtures including some or all of the various xylene isomers, namely 1,2-dimethylbenzene, 1,3-dimethylbenzene, and 1,4-dimethylbenzene (also known as ortho-xylene, meta-xylene, and para-xylene, respectively), as well as significant amounts of ethylbenzene, may be utilized. One useful commercial xylol mixture has been found to include about twenty percent (20%) by weight of 1,4-dimethylbenzene, about fourteen percent (14%) of 1,2-dimethylbenzene, about forty four percent (44%) of 1,3-dimethylbenzene, and about twenty two percent (22%) of ethylbenzene. However, it must be appreciated that other ranges of such xylol mixture components may be used to prepare novel unleaded aviation fuel blends as described herein. And, other aliphatic aromatic hydrocarbons may be useful, with usage adjustable according to performance and economic objectives sought for a particular final unleaded aviation fuel blend.

In most circumstances, FBO Grade 100LL avgas (as discussed elsewhere herein), typically has a MON in excess of the minimum MON required by the applicable ASTM Standard D910-07a. Companies selling avgas typically include a small "MON quality giveaway" to assure that the avgas, at the pump, exceeds the minimum ASTM specifications. Thus, the MON of a FBO Grade 100LL may actually be found, upon sampling and testing, to be in the range of from about 100 to about 105, but more often in the middle of such range. But, the MON of a FBO Grade 100LL may be seen with values of 100, or 100.5, or 101, or 101.5, or 102, or 102.5, or 103, or more. Thus, economics may guide the final blend ratios utilized by a manufacturer of the fuel described herein in producing an aviation fuel blend having a desired final MON. In other words, more or less of a selected alkylated benzene such as 1,3,5tri-methyl benzene may be used in a method of manufacture of an unleaded aviation fuel blend, depending upon how much of an aromatic amine, such as m-toluidine, is used in the final unleaded aviation fuel blend.

In various formulations, an effective amount of 1,3,5tri-methyl benzene may be at least about twenty percent (20%) by weight of a final unleaded fuel blend. In some formulations, to further increase the selected MON of the final unleaded fuel blend, an effective amount of 1,3,5tri-methyl benzene may be at least about thirty percent (30%) of the final unleaded fuel blend. However, at present, I anticipate that the amount of 1,3,5tri-methyl benzene will be about fifty percent (50%) by weight or less of the final unleaded fuel blend.

In an embodiment, it may be anticipated that a final unleaded fuel blend will include about sixty percent (60%) to about seventy percent (70%) by weight of an unleaded aviation gasoline base fuel, and about forty percent (40%) to about thirty percent (30%) by weight of 1,3,5tri-methyl benzene.

Various unleaded aviation gasoline base fuels may be suitable to provide the novel unleaded aviation fuel blends and the accompanying results described herein. For example, an unleaded gasoline base fuel including (by weight) about twenty percent (20%) to about ninety percent (90%) of iso-octane, about one percent (1%) to about twenty percent (20%) of $C_4$ to $C_5$ paraffins, and the balance being primarily light alkylates, would be suitable. In an embodiment, providing iso-octane at about eighty five percent (85%) has been found to be suitable. In an embodiment, a paraffin composition in the ten percent (10%) to twenty percent (20%) range by weight, in the unleaded aviation fuel base, is anticipated to be suitable. In an embodiment, iso-pentane may be used as the paraffin of choice. In such case, iso-pentane in the unleaded aviation gasoline base fuel of about fifteen percent (15%) has been found to be suitable.

Various unleaded aviation gasoline base fuels are available from various refineries, and in various embodiments of an aviation fuel blend as taught herein, variations on the motor octane number (MON) of the aviation gasoline base fuels are anticipated to be workable. For example, in an embodiment, a 95 MON unleaded base fuel is known by my experiments to be workable, by blending an effective amount of 1,3-dimethylbenzene to the base fuel to provide an unleaded aviation gasoline fuel blend meeting the performance objectives as set forth and claimed herein, which in an embodiment include detonation performance equivalent to, or better than, the full scale engine detonation performance of a Grade 100LL fuel that meets the minimum octane rating requirements set forth in ASTM Standard D910-07a. And, in another embodiment, such objectives include detonation performance in a full scale engine equivalent to (FSEEMON), or better than, the full scale engine detonation performance of a selected FBO Grade 100LL fuel having a selected MON. In an embodiment, addition of minor amount of aliphatic aromatic hydrocarbons may be provided, and such mixtures would preferably include such compounds as may enhance the octane performance of the final unleaded aviation gasoline fuel blend. Similarly, it is anticipated that use of a 94 MON base fuel will provide advantageous results, when used with somewhat increased proportions of 1,3-dimethylbenzene, and/or slightly increased proportions of a selected additional alkyl benzene or other aliphatic aromatic hydrocarbon, especially some of the above mentioned compounds that provide octane enhancing properties.

In an embodiment, a novel unleaded fuel blend may include major components of (a) iso-octane, (b) one or more di-alkylated or tri-alkylated benzenes, and (c) minor components including one or more linear paraffins with five or less carbon atoms. In an embodiment, such linear paraffins may comprise butane.

Although many di-alkylated or tri-alkylated benzenes may be included in the novel unleaded fuel blends described herein, including various examples mentioned herein, for example, as occur in xylol mixtures, nonetheless I have found that in various embodiments, useful novel unleaded fuel blends may include, as a significant constituent thereof, certain di-alkylated and/or tri-alkylated benzenes selected from those having the following general structural formula:

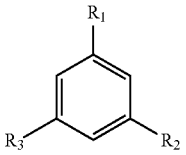

wherein $R_1$, $R_2$, and $R_3$ are selected from the group consisting of hydrogen and alkyl groups having one or more carbon atoms. In an embodiment, $R_1$, $R_2$, and $R_3$ are selected from the group consisting of one to two carbon atoms. In an embodiment, at least one of $R_1$, $R_2$ and $R_3$ consists of hydrogen, and the alkylated benzene is a di-alkylated benzene. In an embodiment, each of $R_1$, $R_2$ and $R_3$ are methyl groups, and thus the alkylated benzene is 1,3,5-trimethylbenzene. In an embodiment, one of $R_1$, $R_2$, and $R_3$ consists of hydrogen, and the remainder of $R_1$, $R_2$ and $R_3$ are methyl groups. In such example, the alkylated benzene is a dimethylbenzene (also known as a xylene). In an embodiment, such xylenes may comprise 1,4-dimethylbenzene. In an embodiment, the unleaded fuel blend comprises alkylated benzenes wherein one of $R_1$, $R_2$, and $R_3$ consists of hydrogen, and the remainder of $R_1$, $R_2$ and $R_3$ are methyl groups in the meta-ring position, and in such embodiment, the meta-ring compound is 1,3-dimethylbenzene.

In an embodiment, an effective amount of 1,3-dimethylbenzene (meta-xylene) may be in the forty five percent (45%) by weight to fifty five percent (55%) by weight range, more or less, of a final unleaded aviation fuel blend, depending up on presence (or absence) of sufficient other octane enhancing compounds as necessary to reach a selected FSEEMON.

As an Example 1, in an embodiment, it may be anticipated that a useful final unleaded aviation fuel blend will include:

(a) about sixty percent (60%) to about forty percent (40%) by weight of an unleaded aviation gasoline base fuel;
(b) about forty percent (40%) to about sixty percent (60%) by weight of one or more di-alkylated or tri-alkylated benzenes; and
(c) about one percent (1%) to about fifteen percent (15%) by weight of one or more selected linear paraffin hydrocarbons.

As an Example 2, in yet another embodiment, it may be anticipated that a useful final unleaded aviation fuel blend will include:

(a) about fifty five percent (55%) to about forty five percent (40%) by weight of an unleaded aviation gasoline base fuel;

(b) about forty five percent (45%) to about fifty five percent (55%) by weight of one or more di-alkylated or tri-alkylated benzenes; and (c) about one percent (1%) to about fifteen percent (15%) by weight of one or more selected linear paraffin hydrocarbons.

As an Example 3, in yet another more specific formulation, it may be anticipated that a useful final unleaded aviation fuel blend will include:

(a) about fifty four percent (54%) by weight of an unleaded aviation gasoline base fuel;

(b) about forty five percent (45%) by weight of one or more di-alkylated or tri-alkylated benzenes;

(c) about one percent (1%) to about fifteen percent (15%) by weight of one or more selected linear paraffin hydrocarbons.

As an Example 4, in yet another more specific formulation, it may be anticipated that a useful final unleaded aviation fuel blend will include:

(a) about fifty four percent (54%) by weight of an unleaded aviation gasoline base fuel;

(b) about forty five percent (45%) by weight of 1,3-dimethylbenzene, and (c) about one percent (1%) to about fifteen percent (15%) by weight of one or more selected linear paraffin hydrocarbons.

As an Example 5, in yet another more specific formulation, it may be anticipated that a useful final unleaded aviation fuel blend will include:

(a) about forty five percent (45%) by weight of an unleaded aviation gasoline base fuel;

(b) about fifty five percent (55%) by weight of one or more di-alkylated or tri-alkylated benzenes;

(c) more than zero percent (0%) to about six percent (6%) by weight of an aromatic amine.

As an Example 6, in yet another more specific formulation, it may be anticipated that a useful final unleaded aviation fuel blend will include:

(a) about forty five percent (45%) by weight of an unleaded aviation gasoline base fuel;

(b) about fifty five percent (55%) by weight of 1,3-dimethylbenzene;

(c) more than zero percent (0%) to about six percent (6%) by weight of meta-toluidine.

As an Example 7, in an embodiment, it has been found that an exemplary unleaded fuel blend can be provided using in the formulation, by weight:

(a) about fifty four percent of an aviation fuel base, the aviation fuel base having a MON of about 95-96, and having primary components of about seventy nine percent (79%) iso-octane and about fifteen percent (15%) iso-pentane, by weight;

(b) about forty five percent (45%) 1,3-dimethylbenzene; and (c) about one percent (1%) butane.

As an Example 8, in an embodiment, it has been found that an exemplary unleaded fuel blend can be provided using in the formulation, by weight, about thirty four percent (34%) of iso-octane (2,2,4-trimethylpentane), about forty four percent (44%) of a mixture of 1,4-dimethylbenzene and 1,3-dimethylbenzene, about four and one-half percent (4.5%) of 1,2-dimethylbenzene, about six percent (6%) isopentane, about three and one-half percent (3.5%) n-butane, two percent (2%) m-toluidine, and about one half percent (0.5%) of tolulene, with the remainder various components in minor amounts as might be expected as a result of normal hydrocarbon manufacturing processes.

In the various examples just mentioned, where not otherwise already specified, methylbenzene (toluene) may be utilized as one of the one or more additional alkylated benzenes. Also, in the various examples just mentioned, where not otherwise already specified, where necessary or required for assuring adequate Reid Vapor Pressure of a final unleaded aviation gasoline fuel blend to meet applicable specifications or service conditions, a suitable unleaded aviation fuel blend may further include more than zero percent (0%) up to about five percent (5%) butane, by weight. Also, for similar reasons, in addition to any iso-pentane or other paraffins that may be present in the aviation fuel base, amounts of more than zero percent (0%) up to about five percent (5%) additional $C_5$-$C_6$ paraffins may be added. In any one of the embodiments set forth, iso-pentane may be selected for further addition to complete a workable, high performance, final unleaded aviation fuel blend.

In the unleaded fuel blends tested as noted above, based on currently available test information, it is believed that one specific advantageous final unleaded fuel blend will include (a) about fifty four percent (54%) by weight of unleaded aviation gasoline base fuel, (b) about forty five percent (45%) by weight of 1,3-dimethylbenzene, and (c) about one percent (1%) by weight of butane. Such a formulation has been demonstrated to provide detonation performance of the unleaded fuel blend to be the functional equivalent of the detonation performance when operated on a full scale aircraft engine (the FSEEMON) of a selected FBO Grade 100LL avgas having a selected MON. Notably, FBO Grade 100LL avgas is considered to provide better performance than a Grade 100LL avgas that merely meets the minimum octane rating requirements set forth in ASTM Standard D910-07a.

Availability of a novel unleaded fuel blend having a functional performance as good or better than traditional aviation gasoline fuels with a motor octane number (MON) of 99.6, or more, which blend provides full scale aircraft piston engine detonation performance as good as, or better than, that currently available using Grade 100LL fuels which minimally meet the MON standards of ASTM Standard D910-07a, will be of considerable interest to a large number of users of high performance aircraft piston engines. Moreover, availability of a novel unleaded fuel blend effective to increase the detonation performance of the unleaded fuel blend to an equivalent (the FSEEMON of the unleaded aviation fuel blend), or better, when tested in a full scale aircraft engine, compared to the detonation performance of a selected FBO Grade 100LL avgas having a selected MON, will be of even more interest to users of high performance aircraft piston engines. This is especially notable, since although various alkylbenzenes have long been utilized in various fuels, in so far as I am aware, mixtures using relatively high amounts of suitable octane enhancing alkylbenzenes, particularly those including meta-ring position methyl groups such as those described herein, have not been evaluated on full scale aircraft engines sufficiently to appreciate the FSEEMON advantage evident, compared to FBO Grade 100LL fuels of selected MON. Thus, reliance on simple ASTM laboratory testing resulted in the failure of others to fully appreciate the FSEEMON advantage that is provided by the novel unleaded fuel blends described herein.

In yet a further embodiment, a method for manufacturing a composition of matter as an unleaded fuel blend is disclosed. Such method may be accomplished by blending (a) an unleaded aviation gasoline base fuel having a selected motor octane number (MON), with (b) a selected amount of one or more alkylated benzenes, to increase the detonation performance of the unleaded fuel blend to an equivalent, or better, compared to the detonation performance of Grade 100LL avgas that meets the minimum octane rating requirements set forth in ASTM Standard D910-07a. In an embodiment, the selected motor octane number of the unleaded aviation gasoline base fuel may be provided having a motor octane number (MON) of 94, or better. In an embodiment, such a method may include providing an unleaded aviation gasoline base fuel having, by weight, (a) about twenty percent (20%) to about ninety percent (90%) of iso-octane, (b) about one percent (1%) to about twenty percent (20%) of $C_4$ to $C_5$ paraffins, and (c) the balance being primarily light alkylates. In an embodiment, the $C_5$ paraffins may include iso-pentane. Further, various embodiments are feasible, as set forth above with respect to various percentages of blend components, and with respect to the specific formulation that have been tested. And, as noted above, where necessary or required for assuring adequate Reid Vapor Pressure of a final unleaded aviation gasoline blend to meet applicable specifications or service conditions, a suitable unleaded fuel blend may be manufactured by including more than zero percent (0%) up to about five percent (5%) butane, by weight. Also, for the same purpose, in addition to any iso-pentane or other paraffins that may be present in the aviation fuel base, amounts of more than zero percent (0%) up to about five percent (5%) additional $C_5$-$C_6$ paraffins can be added. For example, to manufacture any one of the embodiments set forth in the various examples, iso-pentane may be provided to complete a workable, high performance, final unleaded aviation fuel blend.

In yet another embodiment, it should be noted that a method is disclosed for operating a piston driven aircraft engine. Such method includes operating the piston driven aircraft engine with an unleaded aviation fuel blend composition as set forth in any one of the novel aviation fuel blend compositions described herein. For example, such method may include combusting in such an engine an aviation fuel blend manufactured using an unleaded aviation gasoline base fuel having a selected motor octane number (MON) of at least 94, and an amount of one or more selected di-alkylated or tri-alkylated benzenes effective to increase the detonation performance of the unleaded fuel blend to an equivalent, or better, compared to the detonation performance of Grade 100LL avgas that meets the minimum octane rating requirements set forth in ASTM Standard D910-07a. In an embodiment, the amount of one or more selected alkylated benzenes added the aviation fuel blend used in the method will be effective to increase the detonation performance of the unleaded fuel blend to an equivalent (the FSEEMON of the unleaded aviation fuel blend), or better, when tested in a full scale aircraft engine, compared to the detonation performance of a selected FBO Grade 100LL avgas having a selected MON. In an embodiment, alkylated benzenes suitable for use in such method may include those having at least two methyl groups at the meta-ring positions. In an embodiment, a suitable alkyl benzene may be provided using 1,3-dimethylbenzene. In an embodiment, a suitable alkyl benzene may be provided using 1,3,5-trimethylbenzene. In an embodiment, a suitable mix of alkylbenzenes may be provided using both 1,3-dimethylbenzene and 1,3,5-trimethylbenzene. In an embodiment, in addition to using both 1,3-dimethylbenzene and 1,3,5-trimethylbenzene, other xylenes, or constituents from xylol mixtures may be used, including 1,4-dimethylbenzene, 1,2-dimethylbenzene, and ethylbenzene.

In a method of using novel unleaded aviation fuel blends, the unleaded aviation gasoline base fuel may include, by weight, (a) about twenty percent (20%) to about ninety percent (90%) of iso-octane, (b) about one percent (1%) to about twenty percent (20%) of $C_4$ to $C_5$ paraffins, and (c) the balance being primarily light alkylates. In an embodiment, the $C_5$ paraffins may include iso-pentane. Further, various embodiments are feasible for use in a method of operating aircraft engines, using unleaded aviation gasoline fuel blends as set forth above with respect to various percentages of blend components, or with respect to the more specific formulations noted above. And, where necessary or required for assuring adequate Reid Vapor Pressure of a final unleaded aviation gasoline blend to meet applicable specifications or service conditions, fuels having more than zero percent (0%) up to about five percent (5%) butane, by weight may be utilized. Also, for the same purpose, in addition to any iso-pentane or other paraffins that may be present in the aviation fuel base, using amounts of more than zero percent (0%) up to about five percent (5%) additional $C_5$-$C_6$ paraffins can be useful in practice of the method. For example, a fuel that may be used in aircraft engines may be provided in accord with any one of the embodiments set forth herein, using iso-pentane to complete a workable, high performance, final unleaded aviation fuel blend for use in operation of aircraft engines.

In yet another embodiment, using an existing aircraft engine mechanically designed for use by combustion of a fuel having 99.6 motor octane number (MON) or better leaded aviation gasoline, where the engine utilizes a spark ignition system with pistons in cylinders, a method is provided for drop-in substitution of leaded aviation gasoline with an unleaded aviation gasoline fuel blend, where the unleaded aviation fuel blend includes (a) an aviation gasoline base fuel, as described above, (b) a selected amount of one or more di-alkylated or tri-alkylated benzenes. In an embodiment, the unleaded aviation fuel blend includes up to about fifty one percent (51%) by weight of said unleaded aviation gasoline base fuel. In an embodiment, the selected unleaded aviation gasoline base fuel has a selected motor octane number (MON) of at least 94. In an embodiment, an amount of 1,3-dimethylbenzene is provided is effective to increase the detonation performance on a full scale aircraft engine of the unleaded fuel blend to an equivalent, or better, compared to the detonation performance of Grade 100LL avgas that meets the minimum octane rating requirements set forth in ASTM Standard D910-07a. In an embodiment, the amount of one or more selected alkylated benzenes added to the aviation fuel blend will be effective to increase the detonation performance of the unleaded fuel blend to an equivalent (the FSEEMON of the unleaded aviation fuel blend), or better, when tested in a full scale aircraft engine, compared to the detonation performance of a selected FBO Grade 100LL avgas having a selected MON. And, in an embodiment, the unleaded aviation gasoline base fuel may include, by weight, (a) about twenty percent (20%) to about ninety percent (90%) of iso-octane, (b) from about nine percent (9%) to about fifteen percent (15%) of a selected aliphatic aromatic hydrocarbon octane enhancer, and (c) about one percent (1%) to about twenty percent (20%) of $C_4$ to $C_5$ paraffins, and (d) the balance being primarily light alkylates. In an embodiment, the unleaded aviation fuel blend just described for use in the method of drop-in-substitution in an existing engine may have a motor octane number (MON) of at least 99.6.

In an embodiment, the aviation fuel blend just described for use in the method of drop-in-substitution in an existing engine may include blends as set forth in any of the Examples above with respect to various percentages of blend components, or with respect to the more specific formulations. As mentioned above, where necessary or required for assuring adequate Reid Vapor Pressure of a final unleaded aviation gasoline blend to meet applicable specifications or service conditions, fuels having more than zero percent (0%) up to about five percent (5%) butane, by weight may be utilized. Also, for the same purpose, in addition to any iso-pentane or other paraffins that may be present in the aviation fuel base, using amounts of more than zero percent (0%) up to about five percent (5%) additional $C_5$-$C_6$ paraffins can be useful in practice of the method. And, for use as drop-in substitute fuels, fuels may be provided as set forth in any of the embodiments in Examples above, using additional iso-pentane to complete a workable, high performance, final unleaded aviation fuel blend for use in operation of aircraft engines.

In summary, various novel fuel blends have been described, as well as methods for their formulation, preparation, manufacture, and methods for using the same in aircraft engine applications. Testing to date has unexpectedly revealed that it is possible to provide blends of unleaded aviation base fuels with one or more di-alkylated or tri-alkylated benzenes, in order to formulate an unleaded avgas fuel blend that exhibits, in full scale high performance aviation piston engines, detonation performance at least equivalent (the FSEEMON) to that of a selected FBO Grade 100LL avgas having a selected MON. Those alkylated benzenes which provide octane enhancing properties to the fuel blend and which may be particularly useful in providing economic fuel blends are, in an embodiment, those wherein the amount of commercially available di-alkylated benzenes, and particularly xylol mixtures including 1,3-dimethylbenzene, may be maximized in the novel unleaded fuel blend.

Evaluation of the detonation performance properties of various fuel mixtures as described herein may be carried out by methods known to those of skill in the art and to whom this specification is directed, using known methods. For example, attention is drawn to the various FAA reports first noted above, where, for example, the DOT/FAA/AR-TN07/5 report of March 2007, where description is made of the testing of detonation performance of various fuels. Attention is also drawn to ASTM Standard D-2700, entitled "Test Method for Detonation Characteristics of Motor and Aviation Fuels by the Motor Method," which is the test method indicated for use for determination of knock value, lean mixture octane number, under ASTM Standard D910-07a. Also, attention is drawn to ASTM Standard D-6812-04a, entitled "Standard Practice for Ground-Based Octane Rating Procedures for Turbocharged/Supercharged Spark Ignition Aircraft Engines" as that method may be applicable for a particular fuel application. Attention is also drawn to ASTM Standard D-909, entitled "Standard Test Method for Supercharge Rating of Spark-Ignition Aviation Gasoline" as that method may be applicable for certain tests required under the ASTM Standard D910-07a just referred to above.

Various methods are known for manufacture of 1,3,5-trimethylbenzene (mesitylene). Such methods include the following: U.S. Pat. No. 5,087,781 entitled Method of Making Mesitylene, describes the use of a niobium catalyst for vapor phase reaction of acetone. U.S. Pat. No. 3,267,165, entitled Preparation of Mesitylene by Dehydrocondensation of Acetone, describes the reaction of acetone with sulfuric acid and polyphosphoric acid, and recovery of mesitylene by steam distillation. U.S. Pat. No. 2,917,561 entitled Production of Mesitylene, describes the use of a vapor phase reaction using a catalyst. Swift Enterprises, Inc, assignee of US Patent Application Publication No. 2008/0244961 A1, published on Oct. 9, 2008, reveals a biological derived material method for production of Mesitylene.

In the foregoing description, for purposes of explanation, numerous details have been set forth in order to provide a thorough understanding of the disclosed exemplary embodiments for the formulation of aviation fuel blends. For descriptive purposes, various relative terms may be used. Terms that are relative only to a point of reference are not meant to be interpreted as absolute limitations, but are instead included in the foregoing description to facilitate understanding of the various aspects of the disclosed embodiments. And, various actions or activities in a method described herein may have been described as multiple discrete activities, in turn, in a manner that is most helpful in understanding the present invention. However, the order of description should not be construed as to imply that such activities are necessarily order dependent. In particular, certain mixing or blending operations may not necessarily need to be performed in the order of presentation. And, in different embodiments of the invention, one or more activities may be performed simultaneously, rather than sequentially. Also, the reader will note that the phrase "in an embodiment" or "in one embodiment" has been used repeatedly. This phrase generally does not refer to the same embodiment; however, it may. Finally, the terms "comprising", "having" and "including" should be considered synonymous, unless the context dictates otherwise.

Further, it should be understood by those of skill in the art and to whom this specification is directed that the term "aircraft" has been used herein consistent with US Federal Aviation Administration regulations to mean a device that is used or intended to be used for flight in the air. Under the same regulations and as used herein, the term "rotorcraft" means a heavier-than-air aircraft that depends principally for its support in flight on the lift generated by one or more rotors. Similarly, under the same regulations and as used herein, the term "helicopter" means a rotorcraft that, for its horizontal motion, depends principally on its engine-driven rotors. Finally, under the same regulations and as used herein, an "aircraft engine" means an engine that is used or is intended to be used for propelling aircraft. Appurtenances and accessories, and air compressors such as turbochargers, are normally considered by those of skill in the art, and under applicable FAA regulations, as components of the aircraft engines with respect to which they are operably connected. Thus, the unleaded fuel blends described and claimed herein should be considered as useful for such piston driven "aircraft engines".

Importantly, the aspects and embodiments described and claimed herein may be modified from those shown without materially departing from the novel teachings and advantages provided by this invention, and may be embodied in other specific forms without departing from the spirit or essential characteristics thereof. Therefore, the embodiments presented herein are to be considered in all respects as illustrative and not restrictive or limiting. As such, this disclosure is intended to cover the formulations and blends described herein and the legal equivalents thereof. Numerous modifications and variations are possible in light of the above teachings. Therefore, the protection afforded to this invention should be limited only by the claims set forth herein, and the legal equivalents thereof.

I claim:

1. An unleaded avgas fuel blend, comprising:

(a) at least one unleaded aviation gasoline base fuel having a selected motor octane number of about 96 or more;

(b) one or more aromatic amines having the formula

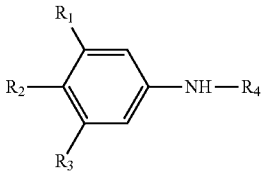

wherein $R_1$, $R_2$, $R_3$ and $R_4$ are hydrogen or a $C_1$-$C_3$ alkyl group, said one or more aromatic amines comprising from more than zero percent (0%) to less than six percent (6%) by weight of said unleaded avgas fuel blend;

(c) an amount of one or more dialkylated benzenes effective to increase the detonation performance of said unleaded fuel blend in a full scale engine to the equivalent, or better than the detonation performance in said full scale aircraft engine of Grade 100LL avgas which minimally meets the minimum octane rating requirements set forth in ASTM Standard D910-07a; and (d) wherein said unleaded avgas fuel blend composition is suitable as a drop-in substitute for Grade 100LL avgas.

2. The unleaded avgas fuel blend as set forth in claim 1, wherein the amount of said one or more dialkylated benzenes is effective to increase the detonation performance of said unleaded fuel blend in a full scale aircraft engine to the equivalent, or better, than the detonation performance in said full scale aircraft engine of a selected Grade 100LL avgas.

3. The unleaded avgas fuel blend as set forth in claim 1, wherein said one or more dialkylated benzenes comprise at least two alkylated benzenes that provide from about forty percent (40%) to about sixty percent (60%) by weight of said unleaded fuel blend.

4. The unleaded avgas fuel blend as set forth in claim 1, or in claim 3, wherein at least one of said one or more dialkylated benzenes comprises 1,3-dimethylbenzene.

5. The unleaded avgas fuel blend as set forth in claim 1, further comprising a xylol mixture, and wherein said one or more dialkylated benzenes is provided as a component of said xylol mixture.

6. The unleaded avgas fuel blend as set forth in claim 5, wherein said xylol mixture comprises 1,2-dimethylbenzene, 1,4-dimethylbenzene, and 1,3-dimethylbenzene.

7. The unleaded avgas fuel blend as set forth in claim 6, wherein said xylol mixture further comprises ethylbenzene.

8. The unleaded avgas fuel blend as set forth in claim 1, or in claim 2, wherein said unleaded aviation gasoline base fuel comprises by weight (a) about twenty percent (20%) to about ninety percent (90%) of iso-octane, (b) about one percent (1%) to about twenty percent (20%) of $C_4$ to $C_5$ paraffins.

9. The unleaded avgas fuel blend as set forth in claim 8, wherein said $C_4$ to $C_5$ paraffins comprise iso-pentane.

10. The unleaded avgas fuel blend as set forth in claim 1, wherein said one or more aromatic amines are present in the range from more than zero about two percent (2%) to about two point seven percent (2.7%) by weight.

11. The unleaded avgas fuel blend as set forth in claim 1, or in claim 10, wherein said one or more aromatic amines comprises m-toluidine.

12. The unleaded avgas fuel blend as set forth in claim 2, further comprising 1,3,5-trimethylbenzene.

13. The unleaded avgas fuel blend as set forth in claim 12, wherein said 1,3,5-trimethylbenzene comprises at least about thirty percent (30%) by weight of said unleaded fuel blend.

14. The unleaded avgas fuel blend as set forth in claim 12, wherein said 1,3,5-trimethylbenzene comprises about fifty percent (50%) or less by weight of said unleaded avgas fuel blend.

15. The unleaded avgas fuel blend as set forth in claim 2, wherein said one or more dialkylated benzenes comprises 1,3-dimethylbenzene.

16. The unleaded awes fuel blend as set forth in claim 15, wherein said 1,3-dimethylbenzene comprises about forty percent (40%) or more by weight of said unleaded avgas fuel blend.

17. The unleaded avgas fuel blend as set forth in claim 15, wherein said 1,3-dimethylbenzene comprises about forty five percent (45%) or more by weight of said unleaded avgas fuel blend.

18. The unleaded avgas fuel blend as set forth in claim 15, wherein said 1,3-dimethylbenzene comprises about fifty percent (50%) or more by weight of said unleaded avgas fuel blend.

19. The unleaded avgas fuel blend as set forth in claim 15, wherein said 1,3dimethyl benzene comprises about fifty five percent (55%) or more by weight of said unleaded avgas fuel blend.

20. The unleaded avgas fuel blend as set forth in claim 15, wherein said 1,3-dimethylbenzene comprises between about forty percent (40%) by weight and about sixty percent (60%) by weight of said unleaded avgas fuel blend.

21. The unleaded avgas fuel blend as set forth in claim 15, wherein said 1,3-dimethylbenzene comprises between about forty five percent (45%) by weight and about fifty five percent (55%) by weight of said unleaded avgas fuel blend.

22. The unleaded avgas fuel blend as set forth in claim 8, further comprising butane.

23. The unleaded avgas fuel blend as set forth in claim 22, wherein butane comprises between about one percent (1%) and about five percent (5%), by weight, of said unleaded avgas fuel blend.

24. An unleaded avgas fuel blend for piston driven aircraft engines, comprising:

(a) about forty percent (40%) to about sixty percent (60%) by weight of an unleaded aviation gasoline base fuel comprising, by weight (1) about twenty percent (20%) to about eighty percent (80%) of iso-octane, said unleaded aviation gasoline base fuel having a selected motor octane number of about 96, or more;

(b) about one percent (1%) to about twenty percent (20%) by weight of $C_4$ to $C_5$ paraffins, and (c) one or more aromatic amines having the formula

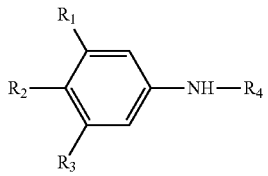

wherein $R_1$, $R_2$, $R_3$ and $R_4$ are hydrogen or a $C_1$-$C_3$ alkyl group, said one or more aromatic amines comprising from more than zero % (0%) to about two point seven percent (2.7%) by weight of said unleaded avgas fuel blend;

(d) about sixty percent (60%) to about forty percent (40%) by weight of one or more dialkylated and/or trialkylated benzenes effective to increase the detonation performance of said unleaded fuel blend in a full scale engine to the equivalent, or better than, the detonation performance in said full scale aircraft engine of Grade 100LL avgas which minimally meets or exceeds the minimum octane rating requirements set forth in ASTM Standard D910-07a; and (e) wherein said unleaded avgas fuel blend composition is suitable as a drop-in substitute for Grade 100LL avgas.

25. The unleaded avgas fuel blend as set forth in claim 24, wherein the amount of said one or more dialkylated and/or trialkylated benzenes is effective to increase the detonation performance of said unleaded fuel blend in a full scale aircraft engine to the equivalent, or better, than the detonation performance in said full scale aircraft engine of a selected Grade 100LL avgas.

26. An unleaded avgas fuel blend, comprising by weight:

(a) about thirty percent (30%) or more of a commercial grade iso-octane having a motor octane number of at least 98;

(b) about forty percent (40%) or more of one or more dialkylated or trialkylated benzenes, said benzenes comprising methylbenzenes with methyl groups at a meta-ring position;

(c) about one percent (1%) or more of at least one selected additional aliphatic aromatic hydrocarbon;

(d) about fifteen percent (15%) or less of iso-pentane; and (e) about ten percent (10%) or less of butane;

(f) one or more aromatic amines having the formula

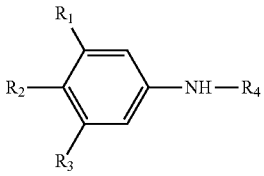

wherein $R_1$, $R_2$, $R_3$ and $R_4$ are hydrogen or a $C_1$-$C_3$ alkyl group, said aromatic amines comprising from more than zero percent (0%) to about two point seven percent (2.7%) of said unleaded avgas fuel blend; and (g) wherein said unleaded avgas fuel blend composition is suitable as a drop-in substitute for Grade 100LL avgas.

27. The unleaded avgas fuel blend as set forth in claim 26, wherein at least one of said one or more dialkylated benzenes comprises 1,3-dimethylbenzene.

28. An unleaded avgas fuel blend, comprising, by weight:

(a) about thirty eight percent (38%) to about forty six percent (46%) of a commercial grade iso-octane having a motor octane number of at least 98;

(b) about forty five percent (45%) to about fifty five (55%) percent 1,3-dimethylbenzene;

(c) about ten percent (10%) or less iso-pentane; and (d) about five percent (5%) or less butane;

(e) an aromatic amine having the formula

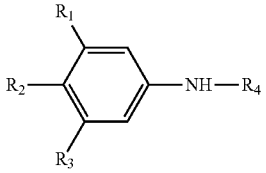

wherein $R_1$, $R_2$, $R_3$ and $R_4$ are hydrogen or a $C_1$-$C_3$ alkyl group, said aromatic amine comprising from more than zero percent (0%) to about two point seven percent (2.7%) of said unleaded avgas fuel blend; and (f) wherein said unleaded avgas fuel blend composition is suitable as a drop-in substitute for Grade 100LL avgas.

29. An unleaded avgas fuel blend, comprising, by weight:

(a) about thirty six point six five percent (36.65%) of iso-octane;

(b) about thirty seven point four percent (37.4%) of 1,3-dimethylbenzene;

(c) about four percent (4%) of 1,4-dimethylbenzene;

(d) about four point three percent (4.3%) of 1,2-dimethylbenzene;

(e) about two point six percent (2.6%) ethylbenzene;

(f) about six point two five percent (6.25%) isopentane;

(g) about four percent (4%) n-butane;

(h) about two point seven percent (2.7%) m-toluidine;

(i) an aromatic amine having the formula

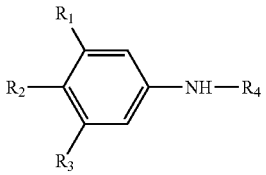

wherein $R_1$, $R_2$, $R_3$ and $R_4$ are hydrogen or a $C_1$-$C_3$ alkyl group, said aromatic amine comprising from more than zero percent (0%) to about two point seven (j) wherein said unleaded avgas fuel blend composition is suitable as a drop-in substitute for Grade 100LL avgas.

30. A method for manufacturing a composition of matter as an unleaded avgas fuel blend suitable as a drop-in substitute for Grade 100LL avgas, said method comprising blending:

(a) an unleaded aviation gasoline base fuel having a selected motor octane number of at least 96;

(b) an aromatic amine having the formula

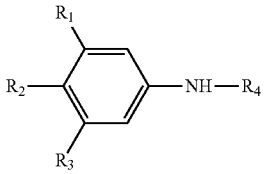

wherein $R_1$, $R_2$, $R_3$ and $R_4$ are hydrogen or a $C_1$-$C_3$ alkyl group, said aromatic amine comprising from more than zero percent (0%) to less than six percent (6%) by weight of said unleaded fuel blend; and (c) a xylol mixture, said xylol mixture comprising an amount of at least one dialkyl benzene, said at least one of said at least one dialkyl benzene comprising a methylbenzene with methyl groups at a meta-ring position, said at least one dialkyl benzene effective to increase the detonation performance of said unleaded avgas fuel blend in a full scale aircraft engine to an equivalent, or better, compared to the detonation performance in said full scale aircraft engine of Grade 100LL avgas that minimally meets the minimum octane rating requirements set forth in ASTM Standard D910-07a.

31. The method as set forth in claim 30, wherein the amount of said one or more dialkyl benzene is effective to increase the detonation performance of said unleaded fuel blend in a full scale aircraft engine to the equivalent, or better, than the detonation performance in said full scale aircraft engine of a selected Grade 100LL avgas.

32. The method as set forth in claim 30, wherein said at least one dialkyl benzene comprises 1,3-dimethylbenzene.

33. The method as set forth in claim 32, wherein said 1,3-dimethylbenzene comprises forty percent (40%) or more by weight of said unleaded avgas fuel blend.

34. The method as set forth in claim 33, wherein said 1,3-dimethylbenzene comprises from about forty five percent (45%) to about fifty five percent (55%) by weight of said unleaded avgas fuel blend.

35. The method of claim 30, wherein said unleaded aviation gasoline base fuel comprises by weight (a) about twenty percent (20%) to about ninety percent (90%) of iso-octane, (b) about one percent (1%) to about twenty percent (20%) of $C_4$ to $C_5$ paraffins, and (c) butane.

36. The method of claim 35, wherein said of $C_4$ to $C_5$ paraffins comprise iso-pentane.

37. The method as set forth in claim 30, wherein said aromatic amine is present in the range from about two percent (2%) to about two point seven percent (2.7%) by weight.

38. The method as set forth in claim 30, wherein said aromatic amine comprises m-toluidine.

39. The method as set forth in claim 30, further comprising adding an amount of 1,3,5-trimethylbenzene effective to increase the detonation performance of said unleaded avgas fuel blend to the full scale engine equivalent motor octane number, or better, as compared to the detonation performance of a selected Grade 100LL avgas.

40. The method as set forth in claim 30, wherein a synergistic amount of said aromatic amine and 1,3,5-trimethylbenzene is added effective to increase the detonation performance of said unleaded fuel blend to the full scale engine equivalent motor octane number, or better, as compared to the detonation performance of a selected Grade 100LL avgas.

41. The method as set forth in claim 30, wherein said selected Grade 100LL avgas has a motor octane number in the range of from about 101 to about 103.

42. The method as set forth in claim 41, wherein said aromatic amine is present in the range from about two percent (2%) to about two point seven percent (2.7%).

43. The method as set forth in claim 42, wherein said aromatic amine comprises m-toluidine.

44. A method for operating a spark ignition piston engine driven aircraft, comprising operating the aircraft engine with the unleaded avgas fuel blend composition as set forth in claim 2.

45. An unleaded avgas fuel blend composition comprising:

(1) an unleaded aviation gasoline base fuel having a motor octane number of about 96, or more, and (2) a substantially positive or synergistic combination of (a) a xylol mixture, and (b) more than zero percent (0%) to six percent (6%) by weight of one or more aromatic amines having the formula

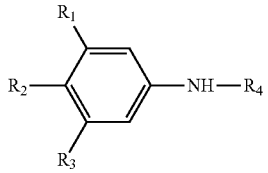

wherein $R_1$, $R_2$, $R_3$ and $R_4$ are hydrogen or a $C_1$-$C_5$ alkyl group.

46. The unleaded avgas fuel blend composition of claim 45, wherein the base fuel comprises about eighty percent (80%) or more by weight of iso-octane.

47. The unleaded avgas fuel blend composition of claim 46, wherein the xylol mixture comprises 1,3-dimethylbenzene.

48. The unleaded avgas fuel blend composition of claim 47, wherein the fuel blend composition comprises at least twenty percent (20%) by weight 1,3-dimethylbenzene.

49. The unleaded avgas fuel blend composition of claim 47, wherein the fuel blend composition comprises at least twenty five percent (25%) by weight 1,3-dimethylbenzene.

50. The unleaded avgas fuel blend composition of claim 46, wherein the composition comprises twenty percent (20%) to thirty percent (30%) by weight alkyl benzenes, said alkyl benzenes comprising alkyl benzenes from said xylol mixture.

51. The unleaded avgas fuel blend composition of claim 45, wherein the one or more aromatic amines comprise m-toluidine.

52. The unleaded avgas fuel blend composition of claim 46, wherein the motor octane number of the unleaded avgas fuel blend composition is in the range of from about 98 to about 105.

53. A method for manufacture of an unleaded avgas fuel blend composition, said method comprising:

(1) selecting a substantially positive or synergistic combination of (a) a xylol mixture, and (b) one or more aromatic amines having the formula

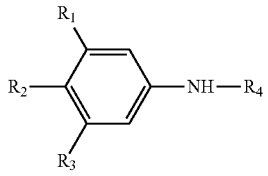

wherein $R_1$, $R_2$, $R_3$ and $R_4$ are hydrogen or a $C_1$-$C_5$ alkyl group, said aromatic amine present in an amount from more than zero percent (0%) to about two point seven percent (2.7%); and (2) combining the combination selected in step (1) with an unleaded aviation base fuel having a motor octane number of at least 96; and (3) wherein said unleaded avgas fuel blend composition comprises a drop-in substitute for Grade 100LL avgas.

54. The method of claim 53 wherein the unleaded aviation base fuel comprises about eighty percent (80%) or more by weight of iso-octane.

55. The method of claim 53, wherein the xylol mixture comprises 1,3-dimethylbenzene.

56. The method of claim 53, wherein said one or more aromatic amines comprises m-toluidine.

57. The method of claim 53, wherein the unleaded avgas fuel blend composition further comprises iso-pentane.

58. The method of claim 57, wherein the unleaded avgas fuel blend composition further comprises butane.

59. The method of claim 58, wherein the motor octane number of the unleaded avgas fuel blend composition is in the range of from 98 to about 105.

60. An unleaded avgas fuel blend, consisting essentially of compounds suitable in combination for use as a drop-in substitute for Grade 100LL avgas, including:

(a) at least one unleaded aviation gasoline base fuel having a selected motor octane number of about 96 or more;

(b) one or more aromatic amines having the formula

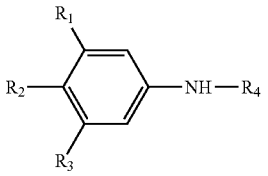

wherein $R_1$, $R_2$, $R_3$ and $R_4$ are hydrogen or a $C_1$-$C_3$ alkyl group, said aromatic amines comprising from more than zero percent (0%) to less than six percent (6%) by weight of said unleaded avgas fuel blend;

(c) an amount of one or more dialkylated benzenes, said one or more dialkylated benzenes comprising from about forty percent (40%) to about sixty percent (60%) by weight of said unleaded fuel blend, said one or more dialkylated benzenes effective to increase the detonation performance of said unleaded fuel blend in a full scale engine to the equivalent, or better than the detonation performance in said full scale aircraft engine of Grade 100LL avgas which minimally meets the minimum octane rating requirements set forth in ASTM Standard D910-07a; and (d) butane, said butane comprising between about one percent (1%) and about five percent (5%), by weight of said unleaded avgas fuel blend.

61. The unleaded avgas fuel blend as set forth in claim 60, wherein the amount of said one or more dialkylated benzenes is effective to increase the detonation performance of said unleaded fuel blend in a full scale aircraft engine to an equivalent or better, compared to the detonation performance in said full scale aircraft engine of a selected Grade 100LL avgas.

62. The unleaded avgas fuel blend as set forth in claim 61, wherein said one or more dialkylated benzenes comprise at least two alkylated benzenes that provide from about forty five percent (45%) by weight to about fifty five percent (55%) by weight of said unleaded avgas fuel blend.

63. The unleaded avgas fuel blend as set forth in claim 62, wherein at least one of said one or more dialkylated benzenes comprises 1,3-dimethylbenzene.

64. The unleaded avgas fuel blend as set forth in claim 62, wherein said avgas fuel blend comprises a xylol mixture including said one or more dialkylated benzenes.

65. The unleaded avgas fuel blend as set forth in claim 64, wherein said xylol mixture comprises 1,2-dimethylbenzene, 1,4-dimethylbenzene, and 1,3-dimethylbenzene.

66. The unleaded avgas fuel blend as set forth in claim 65, wherein said xylol mixture further comprises ethylbenzene.

67. The unleaded avgas fuel blend as set forth in claim 60, wherein said unleaded aviation gasoline base fuel comprises by weight (a) about twenty percent (20%) to about ninety percent (90%) of iso-octane, and (b) about one percent (1%) to about twenty percent (20%) of $C_4$ to $C_5$ paraffins.

68. The unleaded avgas fuel blend as set forth in claim 67, wherein said $C_4$ to $C_5$ paraffins comprise iso-pentane.

69. The unleaded avgas fuel blend as set forth in claim 60, wherein said one or more aromatic amines comprises m-toluidine.

70. The unleaded avgas fuel blend as set forth in claim 69, wherein said m-toluidine is present from about two percent (2%) to about two point seven percent (2.7%) by weight.

71. The unleaded avgas fuel blend as set forth in claim 60, further comprising 1,3,5-trimethylbenzene.

72. The unleaded avgas fuel blend as set forth in claim 71, wherein said 1,3,5-trimethylbenzene comprises at least about thirty percent (30%) by weight of said unleaded fuel blend.

73. The unleaded avgas fuel blend as set forth in claim 60, wherein said one or more dialkylated benzenes comprises 1,3-dimethylbenzene.

74. The unleaded avgas fuel blend as set forth in claim 73, wherein said 1,3-dimethylbenzene comprises about forty percent (40%) or more by weight of said unleaded avgas fuel blend.

75. The unleaded avgas fuel blend as set forth in claim 73, wherein said 1,3-dimethylbenzene comprises about forty five percent (45%) or more by weight of said unleaded avgas fuel blend.

76. The unleaded avgas fuel blend as set forth in claim 73, wherein said 1,3-dimethylbenzene comprises about fifty percent (50%) or more by weight of said unleaded avgas fuel blend.

77. The unleaded avgas fuel blend as set forth in claim 73, wherein said 1,3-dimethylbenzene comprises between about forty percent (40%) by weight and about sixty percent (60%) by weight of said unleaded avgas fuel blend.

78. The unleaded avgas fuel blend as set forth in claim 73, wherein said 1,3-dimethylbenzene comprises between about forty five percent (45%) by weight and about fifty five percent (55%) by weight of said unleaded avgas fuel blend.

79. The unleaded avgas fuel blend as set forth in claim 60, wherein said unleaded aviation gasoline base fuel comprises from about forty percent (40%) to about sixty percent (60%) by weight of said unleaded avgas fuel blend.

80. The unleaded avgas fuel blend as set forth in claim 79, wherein said one or more dialkylated benzenes comprises from about sixty percent (60%) to about forty percent (40%) by weight of said unleaded avgas fuel blend.

81. The unleaded avgas fuel blend as set forth in claim 60, wherein said unleaded avgas fuel blend comprises about ten percent (10%) or less of iso-pentane.

82. An unleaded avgas fuel blend composition consisting essentially of compounds suitable in combination for use as a drop-in substitute for Grade 100LL avgas, including:

(1) an unleaded aviation gasoline base fuel having a motor octane number of about 96, or more, and (2) a substantially positive or synergistic combination of (a) a xylol mixture, and (b) about two percent (2%) to about two point seven (2.7%) by weight of m-toluidine (3) butane, said butane comprising between about one percent (1%) and about five percent (5%) by weight of said unleaded avgas fuel blend.

83. The unleaded avgas fuel blend as set forth in claim 82, wherein said xylol mixture comprises at least two dialkylated benzenes that provide from about forty percent (40%) to about sixty percent (60%) by weight of said unleaded fuel blend.

84. The unleaded avgas fuel blend as set forth in claim 83, wherein at least two dialkylated benzenes comprises 1,3-dimethylbenzene.

85. The unleaded avgas fuel blend composition as set forth in claim 82, wherein the motor octane number the unleaded avgas fuel blend is in the range of from about 98 to about 105.

* * * * *